US009082340B2

(12) United States Patent
Buckley et al.

(10) Patent No.: US 9,082,340 B2
(45) Date of Patent: Jul. 14, 2015

(54) DIGITAL LIGHT MODULATOR CONFIGURED FOR ANALOG CONTROL

(71) Applicant: Pixtronix, Inc., San Diego, CA (US)

(72) Inventors: Edward Buckley, Melrose, MA (US); Fahri Yaras, Chelsea, MA (US); Ilias Pappas, Burlington, MA (US)

(73) Assignee: Pixtronix, Inc., San Diego, CA (US)

( * ) Notice: Subject to any disclaimer, the term of this patent is extended or adjusted under 35 U.S.C. 154(b) by 74 days.

(21) Appl. No.: 13/939,803

(22) Filed: Jul. 11, 2013

(65) Prior Publication Data

US 2015/0015616 A1 Jan. 15, 2015

(51) Int. Cl.

*G09G 3/30* (2006.01)
*G09G 3/20* (2006.01)
*G09G 3/34* (2006.01)

(52) U.S. Cl.

CPC ..... *G09G 3/30* (2013.01); *G09G 3/2022* (2013.01); *G09G 3/2029* (2013.01); *G09G 3/3433* (2013.01); *G09G 2300/0819* (2013.01); *G09G 2300/0842* (2013.01); *G09G 2310/0235* (2013.01); *G09G 2310/0237* (2013.01); *G09G 2320/045* (2013.01); *G09G 2320/064* (2013.01); *G09G 2320/0633* (2013.01); *G09G 2330/028* (2013.01)

(58) Field of Classification Search

CPC ..... G09G 3/30; G09G 3/2022; G09G 3/2029; G09G 3/3433; G09G 2300/0819; G09G 2330/028; G09G 2310/0235; G09G 2310/0237; G09G 2320/045; G09G 2320/0633; G09G 2320/064; G09G 2300/0842

USPC ..... 345/84, 85, 109, 174, 690

See application file for complete search history.

(56) References Cited

U.S. PATENT DOCUMENTS

| | | | |
|---|---|---|---|
| 2008/0129681 | A1 | 6/2008 | Hagood et al. |
| 2011/0164067 | A1 | 7/2011 | Lewis et al. |
| 2011/0292093 | A1 | 12/2011 | Ozawa |
| 2012/0169795 | A1 | 7/2012 | Hagood et al. |
| 2012/0287080 | A1 | 11/2012 | Akimoto |
| 2012/0320110 | A1 | 12/2012 | Tada et al. |

FOREIGN PATENT DOCUMENTS

WO 2013012732 A2 1/2013

OTHER PUBLICATIONS

International Search Report and Written Opinion—PCT/US2014/043435—ISA/EPO—Oct. 6, 2014.

*Primary Examiner* — Premal Patel
(74) *Attorney, Agent, or Firm* — Edward A. Gordon; Foley & Lardner LLP

(57) ABSTRACT

This disclosure provides systems, methods and apparatus for providing analog control for operating the states of a light modulator in a pixel. In one aspect, a pixel circuit can be coupled to the light modulator, and can control the duration for which the light modulator is operated in an open or closed state based on an analog data voltage. In some implementations, the pixel circuit includes a voltage controlled current source (VCCS), which draws a current of a magnitude that is based on the magnitude of the data voltage. The current drawn by the VCCS can be used to control a charge and a voltage on an actuation capacitor coupled to the light modulator. The rate of change of the voltage on the actuation capacitor, and the duration for which the light modulator is maintained in a particular state, is a function of the data voltage applied to the VCCS.

16 Claims, 13 Drawing Sheets

SF5
SF4
SF3
SF2
SF1
1
2
4
8
16
1202

1204
OPEN
CLOSED
LS
Analog operation
Digital operation
1206

1208
$t_{OPEN-3}$
7
$I_{R-3}$
8
16
OPEN
CLOSED
LS
Analog operation
Digital operation
1210

1212
$t_{OPEN-4}$
5
16
OPEN
CLOSED
LS

DIGITAL LIGHT MODULATOR CONFIGURED FOR ANALOG CONTROL

TECHNICAL FIELD

This disclosure relates to the field of imaging displays, and in particular to pixel circuits for display elements.

DESCRIPTION OF THE RELATED TECHNOLOGY

Electromechanical systems (EMS) devices include devices having electrical and mechanical elements, such as actuators, optical components (such as mirrors, shutters, and/or optical film layers) and electronics. EMS devices can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of deposited material layers, or that add layers to form electrical and electromechanical devices.

EMS-based display apparatus have been proposed that include display elements that modulate light by selectively moving a light blocking component into and out of an optical path through an aperture defined through a light blocking layer. Doing so selectively passes light from a backlight or reflects light from the ambient or a front light to form an image.

SUMMARY

The systems, methods and devices of the disclosure each have several innovative aspects, no single one of which is solely responsible for the desirable attributes disclosed herein.

One innovative aspect of the subject matter described in this disclosure can be implemented in a display apparatus including a light modulator capable of switching between two discrete states and a pixel circuit coupled to the light modulator. The pixel circuit includes a data storage element capable of storing a data voltage corresponding to a data value, an actuation charge capacitor, an analog current source coupled to the data storage element and to the actuation charge capacitor, and a switch having a voltage threshold, coupled to the actuation charge capacitor. The analog current source is capable of outputting a current having a magnitude which is based on the data voltage stored on the data storage element to alter an amount of charge and a voltage stored on the actuation charge capacitor at a variable rate. Furthermore, the switch is capable of initiating a change of state of the light modulator in response to the current output by the analog current source causing the voltage stored on the actuation charge capacitor to cross the voltage threshold of the switch.

In some implementations, the light modulator includes a first actuator and a second actuator, and the switch is capable of governing the actuation of one of the actuators. In some implementations, the actuation charge capacitor is coupled to the first actuator, and the voltage stored on the actuation charge capacitor governs the actuation of the other of the actuators. In some implementations, the analog current source is capable of draining the voltage stored on the actuation charge capacitor and one of the actuators. In some implementations, the analog current source is a transistor.

In some implementations, the display apparatus further includes a load protection switch positioned between the analog current source and the actuation charge capacitor capable of selectively preventing the analog current source from draining voltage stored on the actuation charge capacitor. In some implementations, the pixel circuit is capable of both analog and digital operation.

In some implementations, the display apparatus further includes a threshold voltage compensation circuit coupled to the analog current source and the actuation charge capacitor, where the threshold voltage compensation circuit is capable of storing on the data storage element a compensation voltage substantially equal to a threshold voltage of the analog current source in addition to the data voltage. In some implementations, the switch is a voltage inverter.

In some implementations, the display apparatus further includes a display including the array of display elements, and the control matrix. The display further includes a processor that is capable of communicating with the display, the processor being capable of processing image data, and a memory device that is capable of communicating with the processor. In some implementations, the display further includes a driver circuit capable of sending at least one signal to the display, and a controller capable of sending at least a portion of the image data to the driver circuit.

In some implementations, the display apparatus further includes, an image source module capable of sending the image data to the processor, where the image source module includes at least one of a receiver, transceiver, and transmitter. In some implementations, the display further includes an input device capable of receiving input data and to communicate the input data to the processor.

Another innovative aspect of the subject matter described in this disclosure can be implemented in a method for actuating a light modulator capable of switching between two discrete states using a pixel circuit coupled to the light modulator. The method includes storing a data voltage corresponding to a pixel intensity in a data storage element, charging an actuation capacitor to an actuation voltage, selectively discharging the actuation capacitor at a rate based on the magnitude of the data voltage stored on the data storage element, and initiating a change of state of the light modulator in response the actuation voltage crossing a voltage threshold.

In some implementations, selectively discharging the actuation capacitor includes discharging the actuation capacitor via a voltage controlled current source, where the current drawn by the voltage controlled current source is based on the magnitude of the data voltage applied to the voltage controlled current source. In some other implementations, selectively discharging the actuation capacitor includes preventing discharging the actuation capacitor while storing the data voltage in the data storage element.

In some implementations, the method further includes applying an additional compensation voltage to the voltage controlled current source, where the compensation voltage is equal to a threshold voltage of the voltage controlled current source. In some implementations, the method further includes switching the light modulator to an open state when the actuation capacitor is charged to the actuation voltage.

Another innovative aspect of the subject matter described in this disclosure can be implemented in a non-transitory computer readable storage medium having instructions encoded thereon, which when executed by a processor cause the processor to perform a method for displaying an image. In some implementations, the method for displaying the image includes causing storage of a data voltage corresponding to a pixel intensity in a data storage element, initiating charging an actuation capacitor to an actuation voltage, causing selective discharge of the actuation capacitor at a rate based on the magnitude of the data voltage stored on the data storage element, and initiating a change of state of the light modulator in response the actuation voltage crossing a voltage threshold.

In some implementations, causing selective discharge of the actuation capacitor includes causing discharge of the actuation capacitor via a voltage controlled current source, where the current drawn by the voltage controlled current source is based on the magnitude of the data voltage applied to the voltage controlled current source.

Details of one or more implementations of the subject matter described in this specification are set forth in the accompanying drawings and the description below. Although the examples provided in this summary are primarily described in terms of electromechanical systems (EMS) based displays, the concepts provided herein may apply to other types of displays, such as liquid crystal displays (LCDs), organic light-emitting diode (OLED) displays, electrophoretic displays, and field emission displays, as well as to other non-display EMS devices, such as EMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
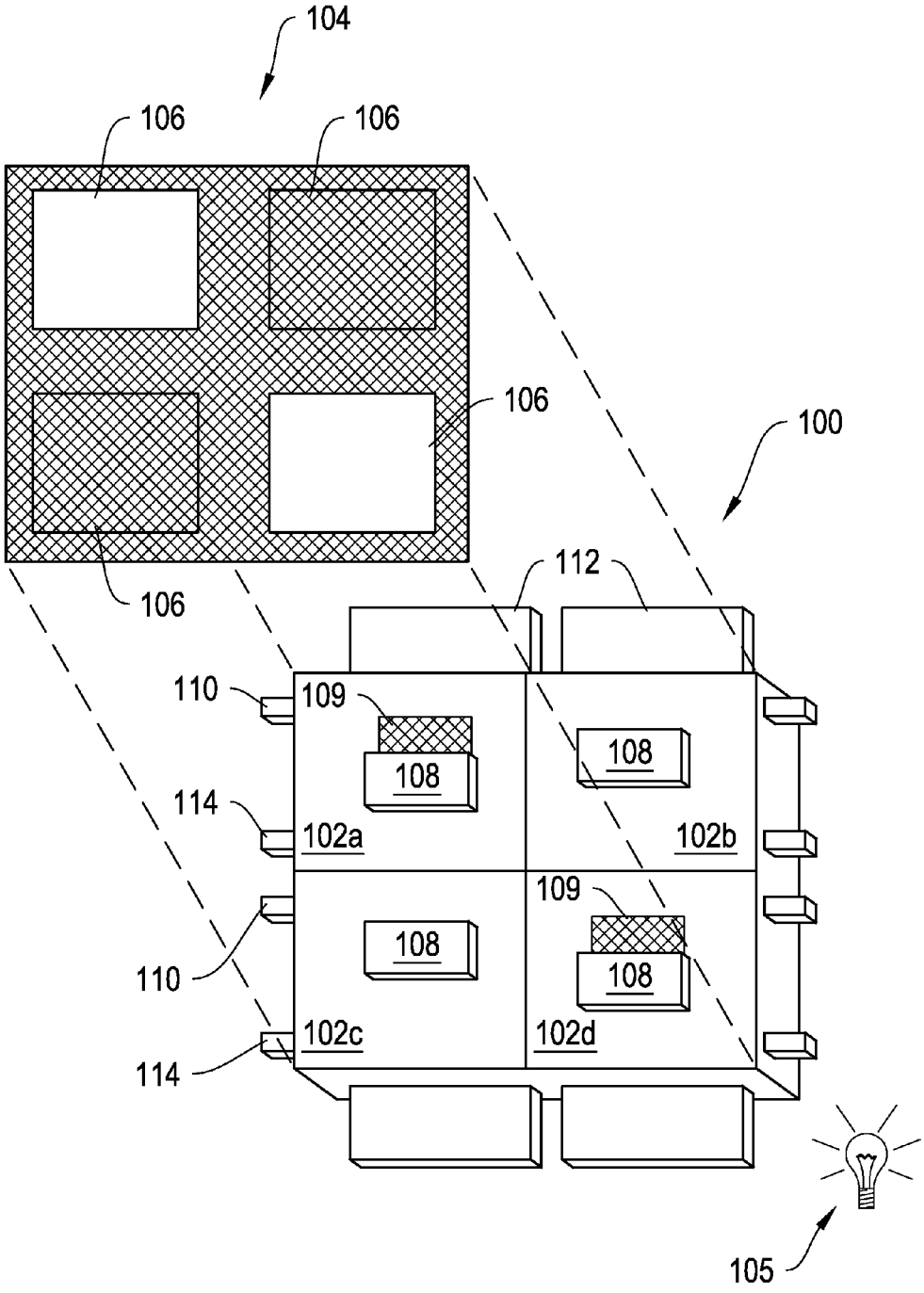
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (for example, e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A display apparatus includes pixel circuits for controlling the state of operation of light modulators. The pixel circuit can be configured to control the state of the light modulator based on an analog data voltage that represents a pixel intensity value of the pixel. In some implementations, the pixel circuit includes an actuation voltage capacitor coupled to an actuator of the light modulator. The pixel circuit can charge the actuation voltage capacitor to force the light modulator to a particular state. The pixel circuit also can include a voltage controlled current source coupled to the actuation voltage capacitor, where the magnitude of current drawn by the voltage controlled current source is based on the data voltage. The voltage controlled current source can be used to decay the voltage stored on the actuation voltage capacitor at a rate that is based on the analog data voltage. This rate of change affects the duration for which the light modulator is maintained in the particular state. Thus, the analog data voltage can control the duration of maintaining the light modulator within a state. In some implementations, the pixel circuit includes a thin film transistor (TFT) for implementing the voltage controlled current source. In some other implementations, the pixel circuit includes a MOSFET.

In some implementations, the pixel circuit can include a compensation circuit configured to make the current drawn by the voltage controlled current source independent of a threshold voltage of the voltage controlled current source.

In some other implementations, the pixel circuit can be configured to vary the duration of operation of the light modulator based on charging the actuation voltage capacitor. Particularly, a discharged actuation voltage capacitor can be charged by a current provided by a voltage controlled current source. The magnitude of current provided by the voltage controlled current source can be a function of the data voltage. Thus, the rate of increase of the voltage across the actuation voltage capacitor can be a function of the analog data voltage. This rate of increase can be used to control the duration of a state of the light modulator in an analog fashion.

In some implementations, the pixel circuit can be configured to implement either digital or analog gray scale.

Particular implementations of the subject matter described in this disclosure can be implemented to realize one or more of the following potential advantages. Controlling the duration of a state of a light modulator using an analog pixel circuit enables the use of analog gray scale techniques in displaying images on a display apparatus. Using analog gray scale techniques can mitigate image artifacts such as flicker, dynamic false contouring (DFC), and color breakup (CBU) that can adversely affect the use of digital gray scale techniques in displaying images.

In some implementations, the complexity of the display apparatus can be simplified due to the elimination of data buffers utilized in digital gray scale techniques.

In some implementations, the number of shutter transitions required before the desired light output for the pixel is achieved can be reduced by using the analog pixel circuit. Reducing the number of transitions, in turn, can reduce overall power consumption of the display apparatus. In addition, light sources can be operated at a higher duty cycle, improving their efficiency and providing further power savings.

The pixel circuit also can include a compensation circuit to improve the precision in controlling the duration of light modulator operation in a particular state. The compensation circuit ensures that unpredictable variations in the pixel circuit components that might arise as a result of temperature changes, fabrication process variations, the inherit properties of the material, etc., do not affect the operation of the pixel circuit.

In some implementations, the same pixel circuit can be used for both analog and digital gray scale techniques for displaying image frames. This allows the display apparatus to readily switch between digital, analog, and hybrid digital-analog modes of operation, which, in turn, can improve the power consumption of the display device.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or backlight so that each pixel can be uniformly illuminated. Transmissive direct-view displays are often built onto transparent or glass substrates to facilitate a sandwich assembly arrangement where one substrate, containing the light modulators, is positioned over the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a scan-line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, $V_{WE}$), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
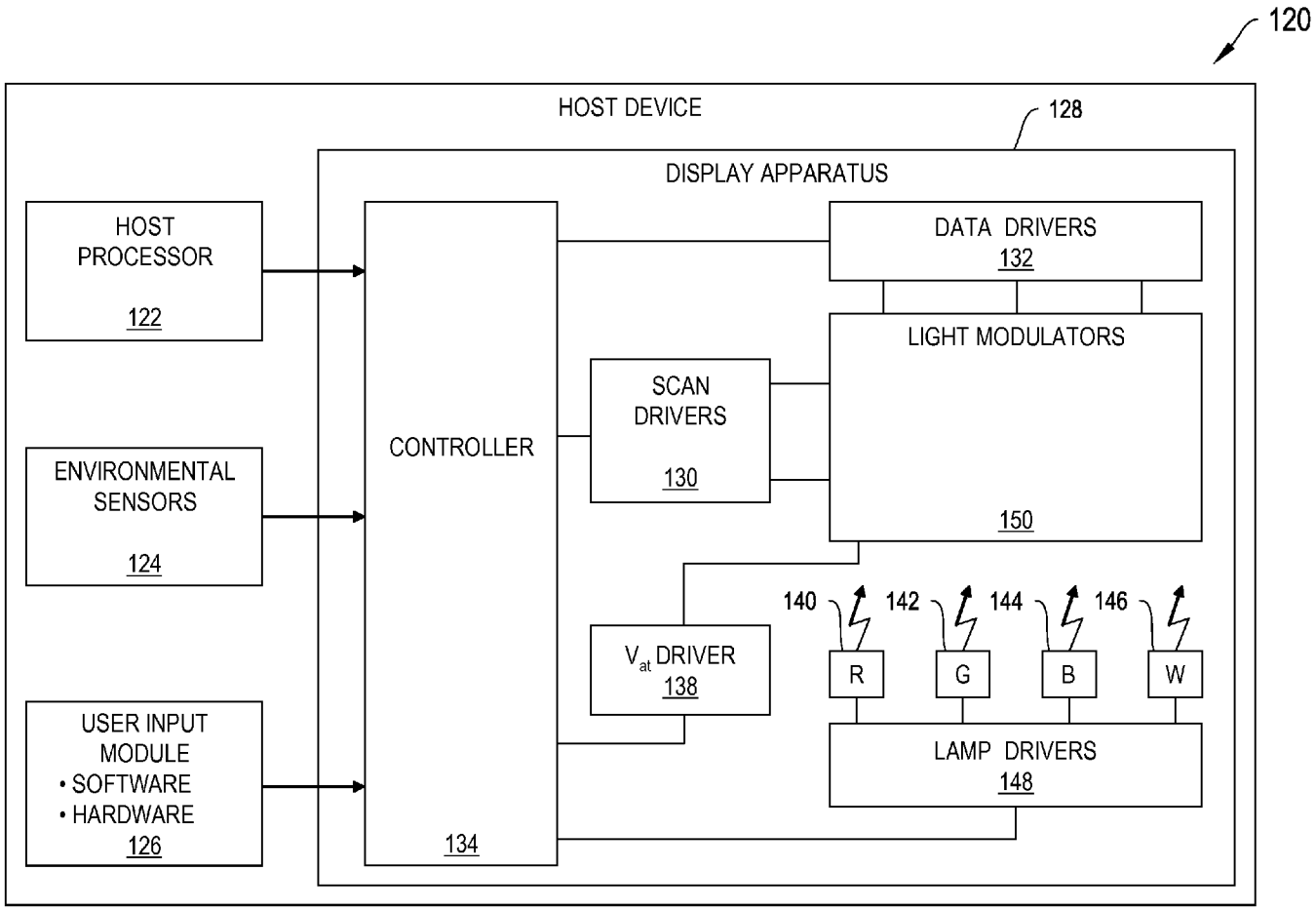
FIG. 1B shows a block diagram of an example host device.

FIG. 1B shows a block diagram of an example host device 120 (i.e., cell phone, smart phone, PDA, MP3 player, tablet, e-reader, netbook, notebook, watch, etc.). The host device 120 includes a display apparatus 128, a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the controller 134). The controller sends data to the data drivers 132 in a mostly serial fashion, organized in sequences, which in some implementations may be predetermined, grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green, blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, blue and white.

In some implementations, where the display apparatus 100 is designed for the digital switching of shutters 108 between open and closed states, the controller 134 forms an image by the method of time division grayscale, as previously described. In some other implementations, the display apparatus 100 can provide grayscale through the use of multiple shutters 108 per pixel.

In some implementations, the data for an image 104 state is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations, the sequencing is organized by blocks, where, for a block, the data for only a certain fraction of the image 104 state is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data;

information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as deeper color, better contrast, lower power, increased brightness, sports, live action, or animation. In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figures 2A, 2B:
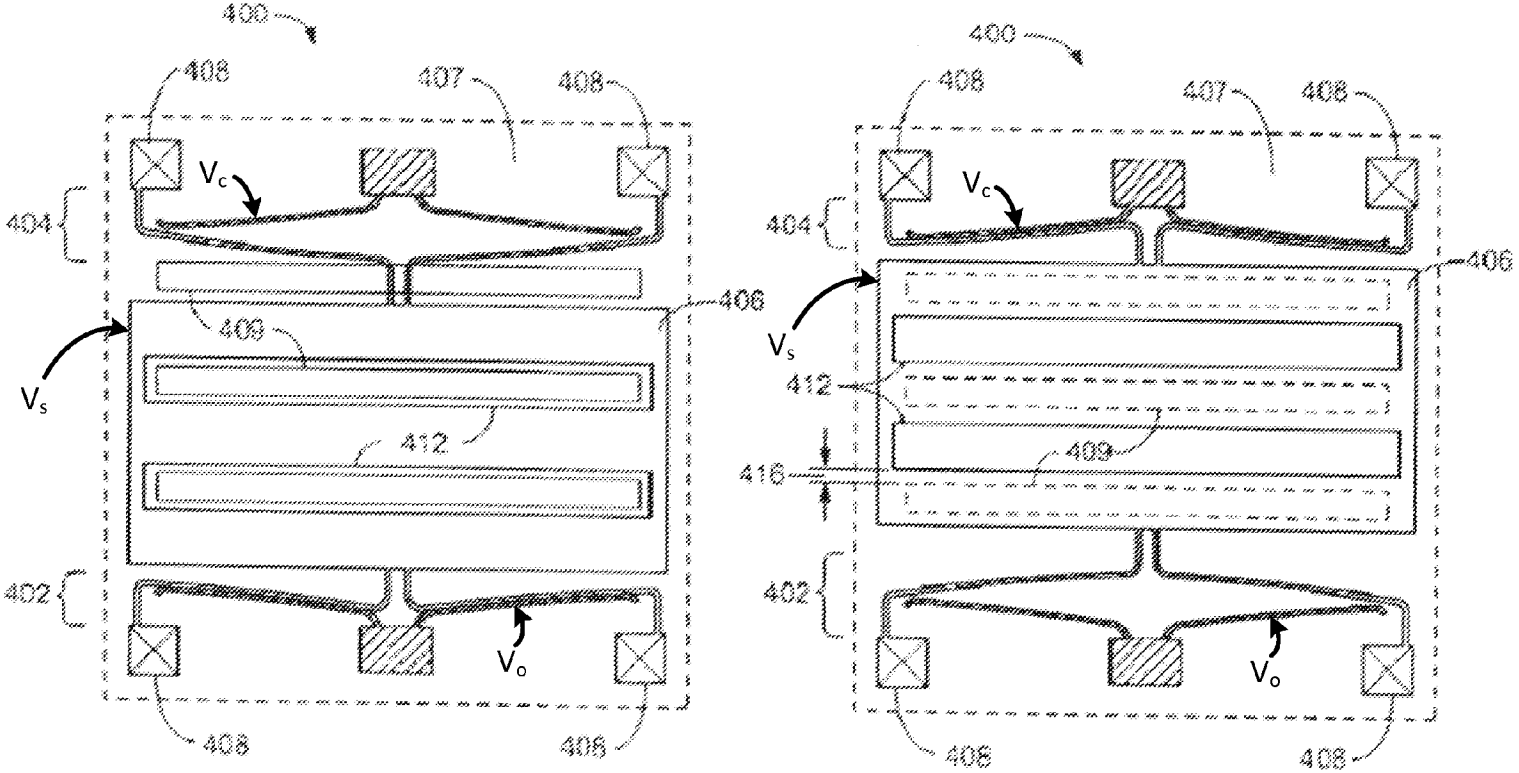
FIGS. 2A and 2B show views of an example dual actuator shutter assembly.

FIGS. 2A and 2B show views of an example shutter based light modulator 400. The light modulator (also referred to as "dual actuator shutter assembly") 400 can include dual actuators for actuating a shutter. The dual actuator shutter assembly 400 can be suitable for incorporation into the direct view MEMS-based display apparatus 100 of FIG. 1A as the light modulator 102. The dual actuator shutter assembly 400, as depicted in FIG. 2A, is in an open state. FIG. 2B shows the dual actuator shutter assembly 400 in a closed state. The shutter assembly 400 includes actuators 402 and 404 on either side of a shutter 406. Each actuator 402 and 404 is independently controlled. A first actuator, a shutter-open actuator 402, serves to open the shutter 406. A second opposing actuator, the shutter-close actuator 404, serves to close the shutter 406. Both of the actuators 402 and 404 are compliant beam electrode actuators. The actuators 402 and 404 open and close the shutter 406 by driving the shutter 406 substantially in a plane parallel to an aperture layer 407 over which the shutter is suspended. The shutter 406 is suspended a short distance over the aperture layer 407 by anchors 408 attached to the actuators 402 and 404. The inclusion of supports attached to both ends of the shutter 406 along its axis of movement reduces out of plane motion of the shutter 406 and confines the motion substantially to a plane parallel to the substrate. As will be described below, a variety of different control matrices may be used with the shutter assembly 400.

The shutter 406 includes two shutter apertures 412 through which light can pass. The aperture layer 407 includes a set of three apertures 409. In FIG. 2A, the shutter assembly 400 is in the open state and, as such, the shutter-open actuator 402 has been actuated, the shutter-close actuator 404 is in its relaxed position, and the centerlines of the shutter apertures 412 coincide with the centerlines of two of the aperture layer apertures 409. In FIG. 2B, the shutter assembly 400 has been moved to the closed state and, as such, the shutter-open actuator 402 is in its relaxed position, the shutter-close actuator 404 has been actuated, and the light blocking portions of the shutter 406 are now in position to block transmission of light through the apertures 409 (depicted as dotted lines).

Each aperture has at least one edge around its periphery. For example, the rectangular apertures 409 have four edges. In alternative implementations in which circular, elliptical, oval, or other curved apertures are formed in the aperture layer 407, each aperture may have only a single edge. In some other implementations, the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 412 and 409 in the open state, it is advantageous to provide a width or size for shutter apertures 412 which is larger than a corresponding width or size of apertures 409 in the aperture layer 407. In order to effectively block light from escaping in the closed state, it is preferable that the light blocking portions of the shutter 406 overlap the apertures 409. FIG. 2B shows an overlap 416, which in some implementations may be predefined, between the edge of light blocking portions in the shutter 406 and one edge of the aperture 409 formed in the aperture layer 407.

The electrostatic actuators 402 and 404 are designed so that their voltage-displacement behavior provides a bi-stable characteristic to the shutter assembly 400. For each of the shutter-open and shutter-close actuators, there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Generally, electrical bi-stability in electrostatic actuators, such as actuators 402 and 404, arises from the fact that the electrostatic force across an actuator is a strong function of position as well as voltage. The beams of the actuators in the light modulators 400 and 450 can be implemented to act as capacitor plates. The force between capacitor plates is proportional to $1/d^2$ where d is the local separation distance between capacitor plates. When the actuator is in a closed state, the local separation between the actuator beams is very small. Thus, the application of a small voltage can result in a relatively strong force between the actuator beams of the actuator in the closed state. As a result, a relatively small voltage, such as $V_m$, can keep the actuator in the closed state, even if other elements exert an opposing force on the actuator.

In dual-actuator light modulators, such as 400 and 450, the equilibrium position of the light modulator will be determined by the combined effect of the voltage differences across each of the actuators. In other words, the electrical potentials of the three terminals, namely, the shutter open drive beam, the shutter close drive beam, and the load beams, as well as modulator position, are considered to determine the equilibrium forces on the modulator.

For an electrically bi-stable system, a set of logic rules can describe the stable states and can be used to develop reliable addressing or digital control schemes for a given light modulator. Referring to the shutter-based light modulator 400 as an example, these logic rules are as follows:

Let $V_s$ be the electrical potential on the shutter or load beam. Let $V_o$ be the electrical potential on the shutter-open drive beam. Let $V_c$ be the electrical potential on the shutter-close drive beam. Let the expression $|V_o-V_s|$ refer to the absolute value of the voltage difference between the shutter and the shutter-open drive beam. Let $V_m$ be the maintenance voltage. Let $V_{at}$ be the actuation threshold voltage, i.e., the voltage to actuate an actuator absent the application of $V_m$ to an opposing drive beam. Let $V_{max}$ be the maximum allowable potential for $V_o$ and $V_c$. Let $V_m<V_{at}<V_{max}$. Then, assuming $V_o$ and $V_c$ remain below $V_{max}$:

$$\text{If } |V_o-V_s|<V_m \text{ and } |V_c-V_s|<V_m \quad \text{(rule 1)}$$

Then the shutter will relax to the equilibrium position of its mechanical spring.

$$\text{If } |V_o-V_s|>V_m \text{ and } |V_c-V_s|>V_m \quad \text{(rule 2)}$$

Then the shutter will not move, i.e., it will hold in either the open or the closed state, whichever position was established by the last actuation event.

$$\text{If } |V_o-V_s|>V_{at} \text{ and } |V_c-V_s|<V_m \quad \text{(rule 3)}$$

Then the shutter will move into the open position.

$$\text{If } |V_o-V_s|<V_m \text{ and } |V_c-V_s|>V_{at} \quad \text{(rule 4)}$$

Then the shutter will move into the closed position.

Following rule 1, with voltage differences on each actuator near zero, the shutter will relax. In many shutter assemblies, the mechanically relaxed position is only partially open or closed, and so this voltage condition is usually avoided in an addressing scheme.

The condition of rule 2 makes it possible to include a global actuation function into an addressing scheme. By maintaining a shutter voltage which provides beam voltage differences that are at least the maintenance voltage, $V_m$, the absolute values of the shutter open and shutter closed potentials can be altered or switched in the midst of an addressing sequence over wide voltage ranges (even where voltage differences exceed $V_{at}$) with no danger of unintentional shutter motion.

The conditions of rules 3 and 4 are those that are generally targeted during the addressing sequence to ensure the bi-stable actuation of the shutter.

The maintenance voltage difference, $V_m$, can be designed or expressed as a certain fraction of the actuation threshold voltage, $V_{at}$. For systems designed for a useful degree of bi-stability, the maintenance voltage can exist in a range between about 20% and about 80% of $V_{at}$. This helps ensure that charge leakage or parasitic voltage fluctuations in the system do not result in a deviation of a set holding voltage out of its maintenance range—a deviation which could result in the unintentional actuation of a shutter. In some systems an exceptional degree of bi-stability or hysteresis can be provided, with $V_m$ existing over a range of about 2% and about 98% of $V_{at}$. In these systems, however, care must be taken to ensure that an electrode voltage condition of $|V_c-V_s|$ or $|V_o-V_{at}|$ being less than $V_m$ can be reliably obtained within the addressing and actuation time available.

In some implementations, the first and second actuators of each light modulator are coupled to a latch or a drive circuit to ensure that the first and second states of the light modulator are the only two stable states that the light modulator can assume.

Several digital display technologies have been developed that rely upon principles of time division to generate gray scale values in images. Some of these digital display technologies also employ field sequential color (FSC). Combining time division gray scale processes with field sequential color techniques can lead to a number of image artifacts, including flicker, dynamic false contouring (DFC) and color breakup (CBU). These artifacts can be overcome, but usually not without sacrificing other image quality parameters, requiring significant additional processing, increased energy consumption, or employing more costly device hardware.

The aforementioned image artifacts can be mitigated, and in some cases eliminated in a field sequential color device, if gray scale is generated using an analog process instead of a digital time division-based process. Such an analog gray scale process can be provided by controlling the time at which a light modulator changes state in an analog fashion, based on an input data value. For example, a light modulator can be maintained in a light transmissive state for a greater amount of time in response to a high data value, and for less time in response to a lower data value.

Figure 3:
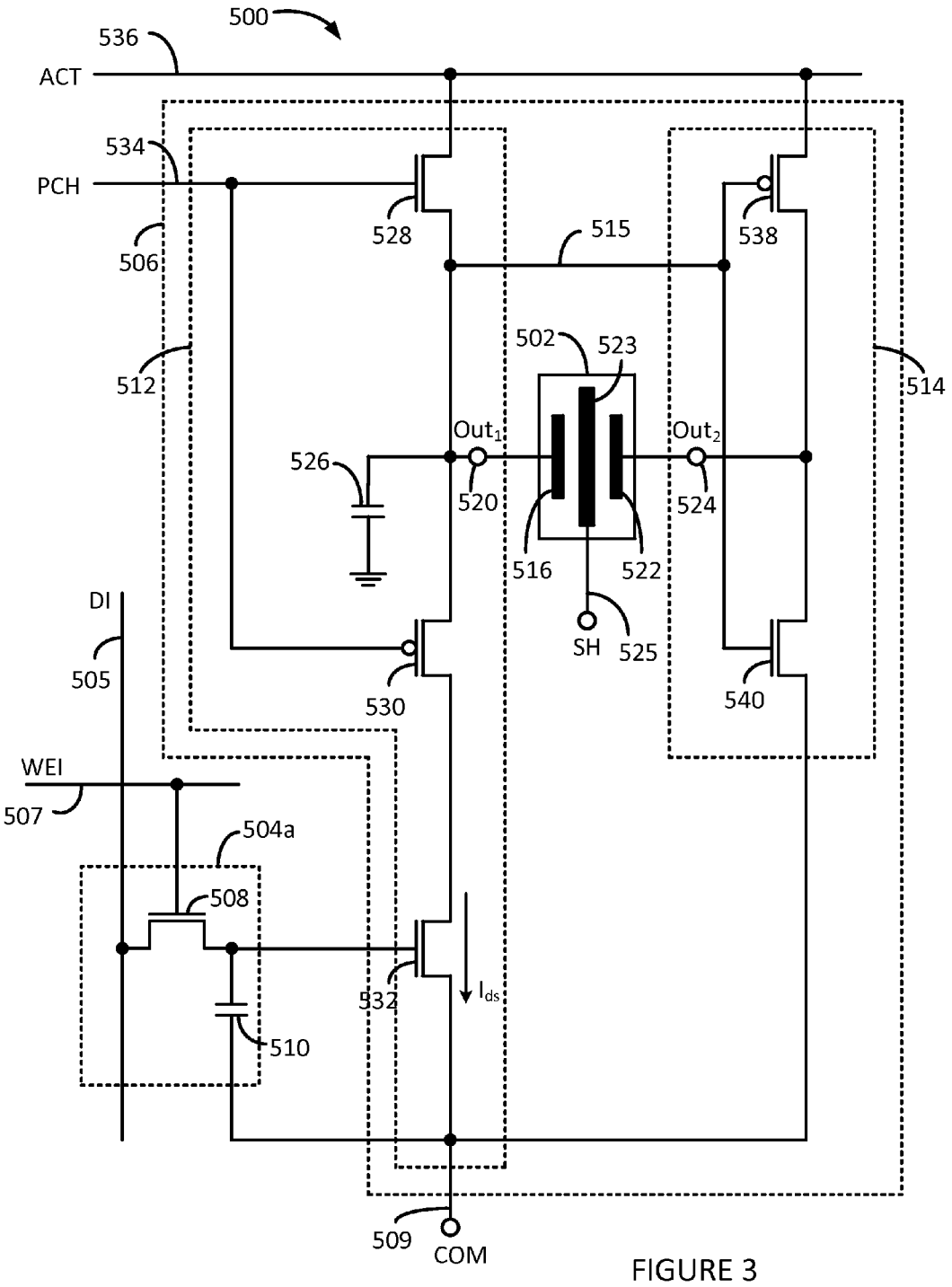
FIG. 3 shows a first example pixel circuit that can be implemented for controlling a light modulator.

FIG. 3 shows a first example pixel circuit 500 that can be implemented for controlling a light modulator 502. In particular, the pixel circuit 500 can be used to control dual actuator light modulators, such as the light modulator 400 shown in FIGS. 2A and 2B. The pixel circuit 500 can be part of a control matrix that controls an array of pixels that incorporate light modulators similar to the light modulator 502.

The pixel circuit 500 includes a data loading circuit **504*a* coupled to an actuation circuit 506. The data loading circuit 504*a* receives and stores data associated with the pixel, while the actuation circuit 506 actuates the light modulator 502 based on the data stored by the data loading circuit 504*a*. In some implementations, various components of the pixel circuit 500 are implemented using TFTs. In some implementations, TFTs manufactured using materials such as amorphous-silicon, indium-gallium-zinc-oxide, or polycrystalline-silicon may be used. In some other implementations, various components of the pixel circuit 500 are implemented using MOSFETs. As will be readily understood by a person having ordinary skill in the art, TFTs are three terminal transistors having a gate terminal, source terminal, and a drain terminal. The gate terminal can act as a control terminal such that a voltage applied to the gate terminal in relation to the source terminal can switch the TFT ON or OFF. In the ON state, the TFT allows electrical current flow from the source terminal to the drain terminal. In the OFF state, the TFT substantially blocks any current flow from the source to the drain. The implementation of the pixel circuit 500**, however, is not limited to TFTs or MOSFETS, and other transistors such as bipolar junction transistors also may be utilized.

As mentioned above, the data loading circuit **504*a* is used to load data associated with the pixel. Specifically, the data loading circuit 504*a* is coupled to a data interconnect (DI) 505, which is common to all the pixels in the same column of the array of pixels. The data interconnect 505** is energized with a data voltage corresponding to the data to be loaded into the pixel. In some implementations, the data voltage can be a voltage between a minimum data voltage, such as ground, and a maximum data voltage. In some implementations, the data to be loaded into a pixel can be a pixel intensity value. In some implementations, the pixel intensity value can be related to the data voltage. For example, the specific magnitude of the data voltage can be inversely proportional to a pixel intensity value identified for the pixel based on image data. In some implementations with a display designed to display 8 bits of gray scale, the pixel intensity value can range from 0 to 255. Thus, a pixel intensity value of 0 would result in a maximum data voltage, whereas a pixel intensity value of 255 would result in a minimum data voltage. In some other implementations, the pixel intensity value of 0 may result in a minimum data voltage, whereas the pixel intensity value of 255 may result in a maximum data voltage. In some implementations, the minimum data voltage can be equal to a threshold voltage of the TFT while the maximum data voltage can be equal to about 25 V, although higher voltages can be used based on the particular design.

The data loading circuit **504*a* is also coupled to a write enabling interconnect (WEI) 507, which is common to all pixels in the same row of the array as the pixel associated with the pixel circuit 500. When the write enabling interconnect 507 is energized with a write enabling voltage, the data loading circuit 504***a* accepts data provided on the data interconnect 505.

To accomplish the data loading function, the data loading circuit 504*a* includes a write enabling transistor 508 and a data storage capacitor 510. The write enabling transistor 508 can be a controllable transistor switch, the operation of which can be controlled by the write enabling voltage on the write enabling interconnect 507. The first terminal, or the gate terminal, of the write enabling transistor 508 can be coupled to the write enabling interconnect 507. The second terminal (drain/source terminal) of the write enabling transistor 508 can be coupled to the data interconnect 505, while the third terminal (drain/source terminal) can be coupled to a data storage capacitor 510. The data storage capacitor 510 can be used to store the data voltage that is representative of the data provided by the data interconnect 505. One terminal of the data storage capacitor 510 is coupled to the write enabling transistor 508, while the other terminal of the data storage capacitor 510 is coupled to a common interconnect (COM) 509. The common interconnect 509 provides a common ground voltage, or some other reference voltage, to pixels in multiple rows and columns of the display apparatus.

As mentioned above, the data loading circuit 504*a* is coupled to the actuation circuit 506. Specifically, the data storage capacitor 510 is coupled to a first actuation sub-circuit 512. The actuation circuit 506 also includes a second actuation sub-circuit 514 coupled to the first actuation sub-circuit 512 via a sub-circuit interconnect 515. The first actuation sub-circuit 512 governs a first output voltage supplied to a first actuator 516 of the light modulator 502. The first actuation sub-circuit 512 is coupled to the first actuator 516 via a first output node ($Out_1$) 520. The second actuation sub-circuit 514 governs a second output voltage supplied to a second actuator 522 of the light modulator 502. The second actuation sub-circuit 514 is coupled to the second actuator 522 via a second output node ($Out_2$) 524. The light modulator also includes a shutter terminal 523, which is typically connected to a shutter interconnect (SH) 525 common to many, and in some implementations all, shutters in a display apparatus. A shutter voltage, similar to the shutter voltage $V_s$ discussed above in relation to the shutter assembly 400 shown in FIGS. 2A and 2B, can be provided to the shutter terminal 523 of the light modulator 502 via the shutter interconnect 525. In some implementations, applying a voltage $V_{OUT1}$ to the first actuator 516 via the first output node 512 and applying a voltage $V_{OUT2}$ to the second actuator 522 via the second output node 524 such that $|V_{OUT1}-V_s|>V_{at}$ and $|V_{OUT2}-V_s|<V_m$ the shutter 523 will move to an OPEN state (as described in rule 3 discussed above in relation to FIGS. 2A and 2B), where $V_{at}$ is the actuation threshold voltage and $V_m$ is the maintenance voltage. Conversely, if $|V_{OUT2}-V_s|>V_{at}$ and $|V_{OUT1}-V_s|<V_m$, the shutter 523 will move to the CLOSED state (see rule 4 discussed above).

The first actuation sub-circuit 512 includes an actuation voltage capacitor 526 coupled to the first output node 520, which is in turn coupled to the first actuator 516. The first actuation sub-circuit 512 controls the voltage across the actuation voltage capacitor 526 by appropriately charging and discharging the actuation voltage capacitor 526. Specifically, the first actuation sub-circuit 512 includes a charging path and a discharging path coupled to the actuation voltage capacitor 526. The charging path includes a pre-charge transistor 528 and the discharging path includes a load protection transistor 530 and a first discharge transistor 532. The pre-charge transistor 528 is controlled by a pre-charge interconnect (PCH) 534 to selectively allow current to flow from an actuation voltage interconnect (ACT) 536, which is maintained at an actuation voltage, to the actuation voltage capacitor 526. In some implementations, the pre-charge transistor 528 can be an n-type TFT. In such an implementation, when a pre-charge voltage is applied to the pre-charge interconnect 534, the pre-charge transistor 528 switches ON and allows the actuation voltage capacitor 526 to be charged to a voltage that is substantially equal to the actuation voltage on the actuation voltage interconnect 536. However, when the pre-charge voltage is removed from the pre-charge interconnect 534, the pre-charge transistor 528 switches OFF and isolates the voltage actuation capacitor 526 from the voltage on the actuation voltage interconnect 536.

The actuation voltage capacitor 526 is also coupled to one terminal of the load protection transistor 530. The load protection transistor 530 also can be controlled by the pre-charge voltage on the pre-charge interconnect 534. However, the load protection capacitor is configured such that its state of operation is the opposite to the state of operation of the pre-charge transistor 528. Thus, when the pre-charge transistor 528 is switched ON (or OFF), the load protection transistor 530 is switched OFF (or ON). In some implementations, the load protection transistor 530 can be a p-type TFT. As such, when the pre-charge voltage is applied to the pre-charge interconnect 534, the load protection transistor 530 is switched OFF, whereas the pre-charge transistor 528 is switched ON for charging the actuation voltage capacitor 526. Furthermore, when the pre-charge voltage is removed from the pre-charge interconnect 534, the load protection transistor 530 switches ON and allows the charge (and the voltage) on the actuation voltage capacitor 526 to be controlled by the first discharge transistor 532.

The first discharge transistor 532 is coupled in series with the load protection transistor 530. Specifically, a drain terminal of the first discharge transistor 532 is coupled to one terminal of the load protection transistor, while the source terminal of the first discharge transistor 532 is coupled to the common interconnect 509. The first discharge transistor 532 can be implemented as a voltage controlled current source. That is, the magnitude of the current flow from the first discharge transistor 532 can be controlled by the magnitude of the voltage being applied to its gate terminal. The gate terminal of the first discharge transistor 532 is coupled to the data storage capacitor 510. Thus, the magnitude of the data voltage stored in the data storage capacitor 510 can control the magnitude of current flow through the first discharge transistor 532. As will be discussed below, this aspect of the first discharge transistor 532 can be used to the control the rate of discharge of the actuation voltage capacitor 526, which in turn can be used to control the duration for which the shutter 523 is maintained in an open or closed state. In some implementations, the first discharge transistor 532 can be an n-type TFT. However, any appropriate voltage controlled current source can be employed.

The second actuation sub-circuit 514 is coupled to the first actuation sub-circuit 512, to the second actuator 522 via the second output node 524, and to the actuation voltage interconnect 536 and the common interconnect 509. As mentioned above, the second actuation sub-circuit 514 controls the voltage applied to the second actuator 522 based on the voltage on the actuation voltage capacitor 526 (i.e., the voltage applied to the first actuator 516). Similar to the first actuation sub-circuit 512, the second actuation sub-circuit 514 also includes a charge path and a discharge path for charging and discharging the second output node 524. The charge path includes a second actuation transistor 538 and the discharge path includes a second discharge transistor 540. One terminal of the second actuation transistor 538 is coupled to the actuation voltage interconnect 536, while a second terminal is coupled to the second output node 524. One terminal of the second discharge transistor 540 is coupled to the second output node 524, while the second terminal is coupled to the common interconnect 509. The control terminals (i.e., gate terminals) of both the second actuation transistor 538 and the second discharge transistor 540 are coupled to the first output node 520 of the first actuation sub-circuit 512 via the sub-circuit interconnect 515. In some implementations, the second actuation transistor 538 can be a p-type transistor and the second discharge transistor 540 can be an n-type transistor.

The second actuation sub-circuit 514, in general, inverts the voltage applied to the first actuator 516 by the first actuation sub-circuit 512, and applies the inverted voltage to the second actuator 522. Thus, when the actuation voltage capacitor 526 is charged to the actuation voltage on the actuation voltage interconnect 536, the second actuation transistor 538 is switched OFF while the second discharge transistor 540 is switched ON, thus, pulling the voltage at the second actuator 522 low. This means that the shutter is in an OPEN position. However, when the voltage on the actuation voltage capacitor 526 goes below a voltage threshold, the second actuation transistor 538 switches ON and the second discharge transistor 540 switches OFF. This causes the second actuator 522 to be charged to the actuation voltage on the actuation voltage interconnect 536, resulting in the shutter 523 to be switched to the CLOSED position.

Figure 4:
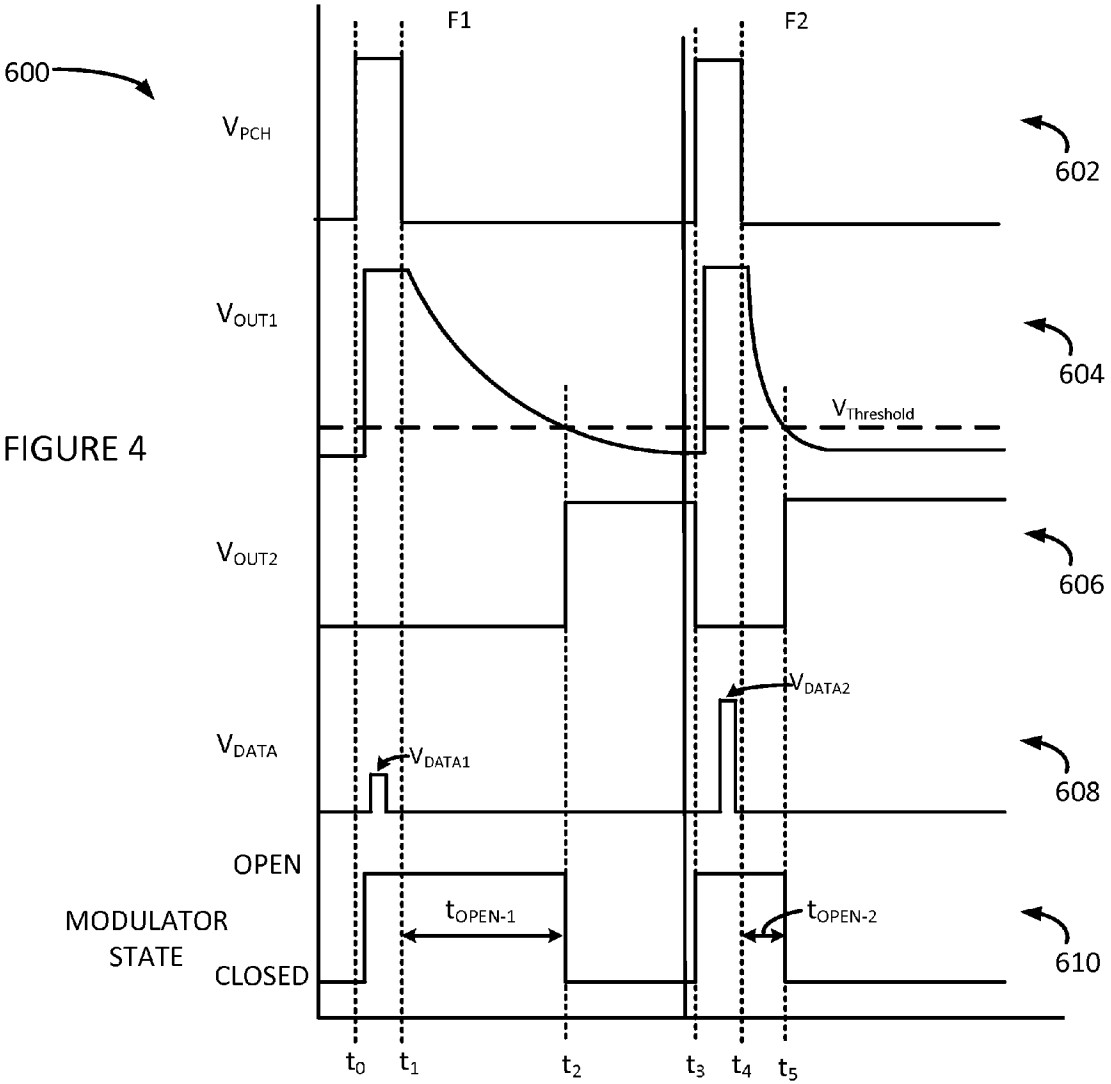
FIG. 4 shows an example timing diagram for the pixel circuit shown in FIG. 3.

FIG. 4 shows an example timing diagram 600 for the pixel circuit 500 shown in FIG. 3. In particular, the timing diagram shows voltage levels at various nodes of the pixel circuit 500 over two image frames Fl and F2. $V_{PCH}$ 602 represents the voltage on the pre-charge interconnect 534, $V_{OUT1}$ 604 represents the voltage at the first output node 520, $V_{OUT2}$ represents the voltage at the second output node 524, $V_{DATA}$ represents the data voltage on the data interconnect 505, and MODULATOR STATE 610 represents the state of the shutter 523 of the light modulator 502. Each voltage shown in FIG. 4 generally swings between a high and a low value. But the high and low values for any one voltage may or may not be equal to the high and low values for another voltage. The rise and fall times for various voltages in the timing diagram 600 are merely for illustration, and may not represent the actual rise and fall times of these voltages.

The first frame F1 begins at time $t_0$ with the pre-charge voltage $V_{PCH}$ 602 on the pre-charge interconnect 534 going high. Referring to FIG. 3, the pre-charge interconnect 534 is coupled to the gate terminals of both the pre-charge transistor 528 and the load protection transistor 530. Assuming that the voltage on the actuation voltage capacitor 526 is discharged, a high voltage on the pre-charge interconnect 534 would switch ON the pre-charge transistor 528 and switch OFF the load protection transistor 530. Switching ON the pre-charge transistor 528 causes current to flow from the actuation voltage interconnect 536 (which is typically maintained at a high value) to the actuation voltage capacitor 526. The charging of the voltage actuation capacitor 526 causes the voltage at the first output node 520 to increase, as shown by voltage $V_{OUT1}$ 604 in FIG. 4. The first output node 520 is coupled to the first actuator 516. Thus, a high voltage on the first output node 520 actuates the first actuator 516. As mentioned above, actuating the first actuator 516 causes the shutter to be switched to the OPEN position, as shown by the MODULATOR STATE 610 in FIG. 4.

The second actuation sub-circuit 514 inverts the voltage at the first output node 520 and applies the inverted voltage at the second output node 524. Specifically, the high voltage on the first output node 520 switches ON the second discharge transistor 540 and switches OFF the second actuation transistor 538. As a result, the voltage $V_{OUT2}$ 606 at the second output node 524, and therefore at the second actuator 522, is low.

While the pre-charge interconnect 534 is being maintained at a high voltage, a data voltage $V_{DATA}$ is applied to the data interconnect 505, thereby storing the data voltage on the data store capacitor 510.

At time $t_1$, the voltage on the pre-charge interconnect 534 is brought low. This results in the pre-charge transistor 528 switching OFF, and the load protection transistor 530 switching ON. As the load protection transistor 530 is switched ON, the rate of discharging of the actuation voltage capacitor depends upon the first discharge transistor 532, and in particular on the data voltage applied to the gate of the first discharge transistor 532. As mentioned above, the first discharge transistor 532 is configured as a voltage controlled current source. Therefore, the magnitude of the current flowing through the first discharge transistor 532 is a function of the data voltage $V_{DATA1}$. The magnitude of current flowing through the first discharge transistor 532 determines the rate of discharge of the actuation voltage capacitor 526, which in turn determines the rate of decay of the actuation voltage across the actuation voltage capacitor 526. Thus, the voltage $V_{OUT1}$ 604 at the first output node 520 begins to decay at time $t_1$ at a rate that is a function of the data voltage $V_{DATA1}$.

The voltage $V_{OUT1}$ 604 at the first output terminal 520 is applied to the gate terminals of the second actuation transistor 538 and the second discharge transistor 540 of the second actuation sub-circuit 514. Note that at time $t_1$, when the $V_{OUT1}$ 604 is high, the second actuation transistor 538 is switched OFF, while the second discharge transistor 540 is switched ON. As $V_{OUT1}$ 604 decreases, it reaches a voltage threshold (denoted as $V_{threshold}$ in FIG. 4) at time $t_2$. When $V_{OUT1}$ 604 is at or below the voltage threshold, the second actuation transistor 538 will be in the ON state while the second discharge transistor 540 will be in the OFF state. As a result, the voltage $V_{OUT2}$ 606 at the second output node 524 is pulled high. The second actuator 522 is actuated, resulting in the shutter being switched to the CLOSED state, as shown by the MODULATOR STATE 610 in FIG. 4. The duration for which the shutter 523 remains in the OPEN state after the pre-charge voltage is removed is denoted by $t_{OPEN\text{-}1}$.

As discussed above, the display apparatus forms an image by a combination of illuminating light sources of one or more color and by switching the states of pixels to be in an OPEN or CLOSED state, based on image data, during the period of illumination. In some implementations, the light sources can be turned on at time $t_1$, when the pre-charge interconnect 534 is brought low and the voltage $V_{OUT1}$ across the actuation voltage capacitor 526 begins to decay. In some other implementations, the light sources can be turned on some time after time $t_1$ to allow shutters that receive a data voltage corresponding to a 0 intensity (i.e., that are to be fully dark or in the CLOSED state for the full image frame) to close before the light source is turned ON. In such implementations, the time $t_{OPEN\text{-}1}$ may begin from the time the light sources are turned on; instead of beginning from the time $t_1$ when the pre-charge interconnect 534 is brought low. The duration of time $t_{OPEN\text{-}1}$ and the illumination intensity of the light source, in combination, can determine the resultant pixel intensity of the pixel. Generally, the light source illumination intensity is kept constant throughout the frame. Therefore, the desired pixel intensity can be achieved by appropriately configuring the time $t_{OPEN\text{-}1}$ for which the shutter remains in the OPEN state.

The next frame F2 begins at time $t_3$ with the pre-charge voltage $V_{PCH}$ 602 going high. As a result, the first pre-charge transistor 528 is switched ON, while the load protection transistor 530 is switched OFF. The actuation voltage capacitor 526 is charged, which results in voltage $V_{OUT1}$ at the first output node 520 to go high. As mentioned above, the second actuation sub-circuit 514 inverts the voltage at the first output node 520 and applies the inverted voltage to the second output node 524. Thus, the voltage $V_{OUT2}$ applied to the second actuator 522 is pulled low. As a result, the high voltage on the first output node 520 causes the first actuator 516 to actuate, resulting in the shutter 523 to switch to an OPEN state.

While the pre-charge interconnect 534 is being maintained at a high voltage, a data voltage $V_{DATA2}$ is applied to the data interconnect 505, thereby storing the data voltage on the data store capacitor 510. Note that $V_{DATA2}>V_{DATA1}$; i.e., the voltage applied to the gate terminal of the first discharge transistor 532 will be greater in frame F2, than that in the previous frame F1.

At time $t_4$, the voltage on the pre-charge interconnect 534 is brought low. As a result, the pre-charge transistor 528 switches OFF and the load protection transistor 530 is switched ON. The current flowing through the first discharge transistor 532 is a function of $V_{DATA2}$. Thus, as $V_{DATA2}>V_{DATA1}$, the current flowing through the first discharge transistor 532 corresponding to $V_{DATA2}$ will be greater than that corresponding to $V_{DATA1}$. As a result, the rate of decay of the actuation voltage on the actuation voltage capacitor 526 will be higher in frame F2 than that in frame F1. Due to the higher rate of decay, the voltage $V_{OUT1}$ will reach $V_{threshold}$ faster than it did in frame F1. As soon as the voltage $V_{OUT1}$ reaches $V_{threshold}$, the second actuation sub-circuit 514 pulls the voltage $V_{OUT2}$ 606 on the second output node 524 high, actuating the second actuator 522 and switching the shutter 523 to a CLOSED state. As during the frame F1, a light source is turned on during the frame F2. This light source can be turned on at time $t_4$ when the pre-charge interconnect 534 is brought low or shortly thereafter to allow for shutters receiving data indicating they are to be in a fully dark state to close. The combination of the light source being on and the shutter being in the OPEN state contributes to the pixel intensity of the pixel associated with the pixel circuit 500.

The duration for which the shutter remains in the OPEN state after the pre-charge voltage is removed is denoted by $t_{OPEN-2}$. As depicted in FIG. 4, $t_{OPEN-2}<t_{OPEN-1}$. In general, the duration for which the shutter is open can be adjusted for each frame by loading the appropriate data voltage on the data interconnect 505. This data voltage, which in some implementations is analog, can be selected based on the data to be loaded into the pixel associated with the pixel circuit 500. As mentioned above, in some implementations, the lowest data voltage may represent the highest pixel intensity value while the highest data voltage may represent the lowest pixel intensity value to be loaded into the pixel associated with the pixel circuit 500. In some other implementations, the reverse could be implemented, where the lowest voltage may represent the lowest pixel intensity value while the highest data voltage may represent the highest pixel intensity value.

Figure 5:
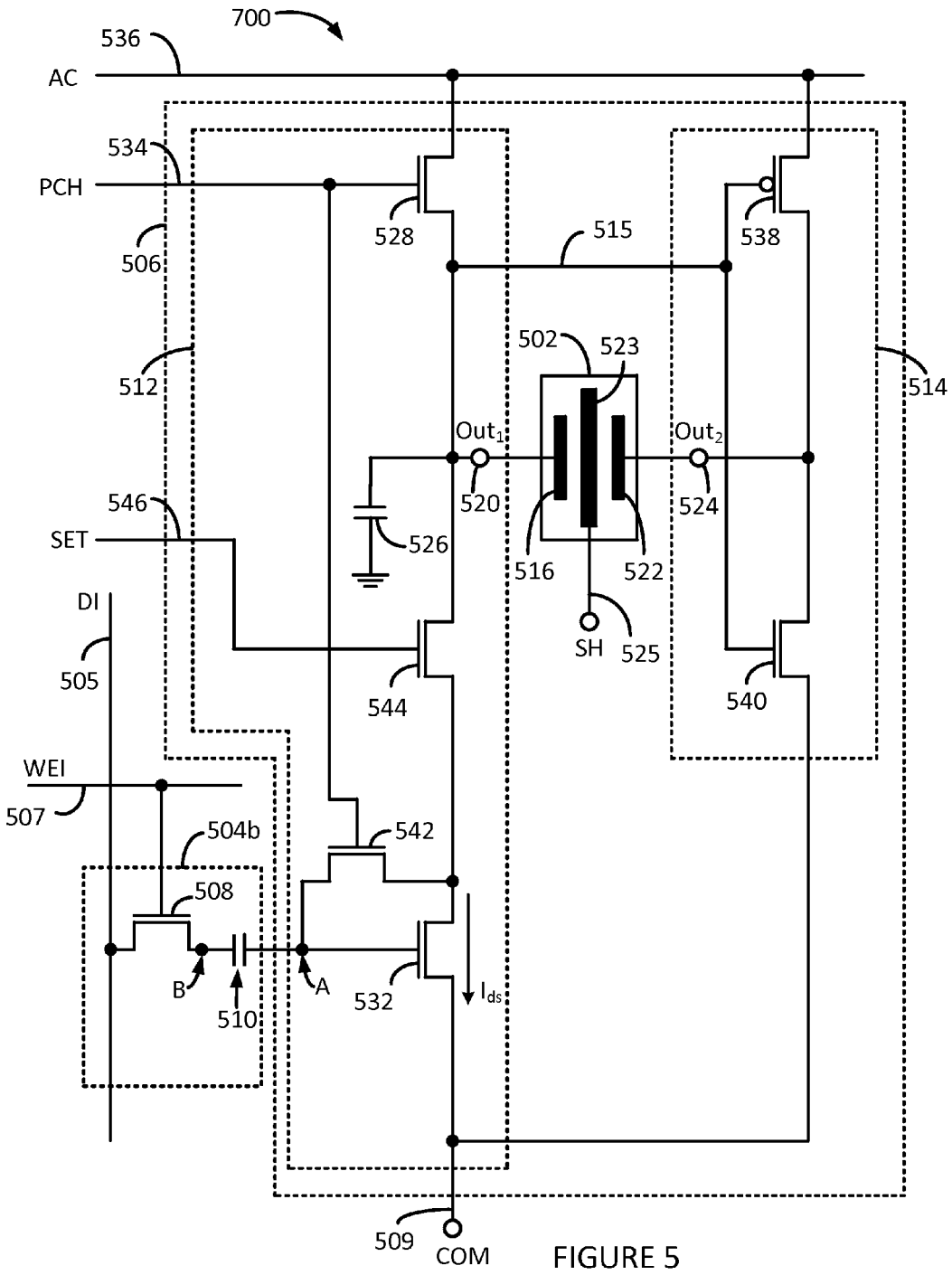
FIG. 5 shows a second example pixel circuit that can be implemented for controlling a light modulator.

FIG. 5 shows a second example pixel circuit 700 that can be implemented for controlling a light modulator 502. In particular, the pixel circuit 700 can be used to control dual actuator light modulators, such as the light modulator 400 shown in FIGS. 2A and 2B. The pixel circuit 700 can be part of a control matrix that controls an array of pixels that incorporate light modulators similar to the light modulator 502. In many respects, the pixel circuit 700 shown in FIG. 5 is similar to the pixel circuit 500 shown in FIG. 3. However, the pixel circuit 700 includes additional circuitry for threshold voltage compensation.

Referring back to the pixel circuit 500 of FIG. 3, the current $I_{ds}$ flowing through the first discharge transistor 532, which is an example of a voltage controlled current source, can be expressed by: $I_{ds}=k(V_{gs}-V_{th})^2$, where 'k' is the gain, '$V_{gs}$' is the voltage across the gate terminal and the source terminal (connected to the common interconnect 509), and '$V_{th}$' is the threshold voltage of the first discharge transistor 532. Thus, the magnitude of the current $I_{ds}$ is, in part, a function of the threshold voltage $V_{th}$ of the first discharge transistor 532. In some implementations, the threshold voltage $V_{th}$ can be a function, in part, of one or more of the temperature, the manufacturing process (including the annealing process and the deposition process) and materials used to fabricate the transistor, and any DC bias on the transistor that may exist, etc., each of which may vary unpredictably. Therefore, unpredictable variations in the threshold voltage $V_{th}$ may cause unpredictable variations in the magnitude of the current $I_{ds}$. As mentioned above, the duration $t_{OPEN}$ for which the shutter 523 remains in the OPEN state is based, in part, on the magnitude of the current $I_{ds}$ flowing through the first discharge transistor 532. Thus, unpredictable variations in the magnitude of the current $I_{ds}$ may undesirably cause unpredictable variations in the duration $t_{OPEN}$ and the output light intensity of a pixel. The pixel circuit 700 shown in FIG. 5 includes circuitry that provides threshold voltage compensation, which results in the current $I_{ds}$ being substantially independent of the threshold voltage $V_{th}$ of the first discharge transistor 532.

Referring to the pixel circuit 700 of FIG. 5, the pixel circuit 700 includes a compensation transistor 542 for providing threshold voltage compensation. The gate terminal of the compensation transistor 542 is coupled to the pre-charge interconnect 534, while one each of the other two terminals is coupled to the gate terminal and the drain terminal, respectively, of the first discharge transistor 532. Furthermore, in contrast to the pixel circuit 500 shown in FIG. 3, which includes a p-type load protection transistor 530, the pixel circuit 700 shown in FIG. 5 instead includes an n-type load protection transistor 544. Furthermore, the gate terminal of the n-type load protection transistor 544 is coupled to a set-interconnect 546. Also in contrast to the pixel circuit 500 shown in FIG. 3, in which the data storage capacitor 510 is coupled between the write enabling transistor 508 and the common interconnect 509, the data storage capacitor 510 of the data loading circuit 504*b* in pixel circuit 700 is instead coupled between the write enabling transistor 508 and the gate terminal of the first discharge transistor 532.

During operation, the pre-charge voltage on the pre-charge interconnect 534 is brought high. In addition, a set-voltage on the set-interconnect 546 is brought high, and both the write enable interconnect 507 and the data interconnect 505 are maintained at a low voltage. As a result, the pre-charge transistor 528, the load protection transistor 544, and the compensation transistor 542 are switched ON. This allows current to flow from the actuation voltage interconnect 536 to the charge actuation voltage capacitor 526 and node A. The voltage $V_A$ at node A will typically rise above the threshold voltage of the first discharge transistor 532. As the pre-charge transistor 528 and the load protection transistor 544 are both switched ON, the switching ON of the first discharge transistor 532 (due to the voltage at node A rising above the threshold voltage of the first discharge transistor 532) may cause an undesirable current path between the actuation voltage interconnect 536 and the common interconnect 509. To avoid such a condition, the voltage at the common terminal 509 can be raised high to prevent the first discharge transistor 532 from switching ON. As the voltage at the first output node 520 is high, the second actuation sub-circuit 514 pulls the voltage at the second output node 524 low. Thus, the shutter 523 is moved to the OPEN state.

Subsequently, the set-voltage on the set-interconnect 546 is brought low. Therefore, the load protection transistor 544 is switched OFF. However, the pre-charge interconnect 534 is still maintained at a high voltage. Thus, the pre-charge transistor 528 and the compensation transistor 542 remain switched ON. Furthermore, the voltage at the common interconnect 509 is brought low so as to allow the first discharge transistor to switch ON. As the voltage $V_A$ at node A is greater than the threshold voltage of the first discharge transistor 532, the first discharge transistor 532 will switch ON. Thus, a current path is formed from the node A to the common interconnect 509 via the compensation transistor 542 and the first discharge transistor 532. As a result, the voltage $V_A$ at node A will begin to decrease. However, as the first discharge transistor 532 is effectively diode connected due to the ON state of the compensation transistor 542, the first discharge transistor 532 will switch OFF as soon as the voltage $V_A$ at node A decreases to the threshold voltage $V_{th}$ of the first discharge transistor 532.

The operation then proceeds to load the data voltage on the data storage capacitor 510. However, prior to loading the data voltage, the pre-charge interconnect 534 and the set-interconnect 546 are brought low. A data voltage $V_{data}$ is applied to the data interconnect 505 and the write enable interconnect 507 is brought high. Thus, the write enabling transistor 508 switches ON, charging node B to the data voltage $V_{data}$. As the data storage capacitor 510 is a floating capacitor, the voltage $V_A$ at node A would also increase by $V_{data}$. Thus, the voltage $V_A$ at node A can be given by the expression:

$$V_A=V_{th}+V_{data}.$$

After the data voltage $V_{data}$ is loaded on the data storage capacitor 510, the data interconnect 505 and the write enable interconnect 507 are brought low. Additionally, the set-interconnect 546 is brought high while the pre-charge interconnect 534 is maintained at a low voltage. As the set-interconnect 546 is high, the load protection transistor 544 is switched ON. Furthermore, as the voltage at the gate terminal of the first discharge transistor 532 is at voltage $V_A$, which is greater than its threshold voltage, the first discharge transistor 532 is also switched ON. As both the load protection transistor 544 and the first discharge transistor 532 are ON, the actuation voltage capacitor 526 will begin to discharge.

The rate of discharge of the actuation voltage capacitor 526 depends upon the magnitude of the current flowing through the first discharge transistor 532. As mentioned above, the current flowing through the first discharge transistor 532, which is configured as a voltage controlled current switch, can be expressed as $I_{ds}=k(V_{gs}-V_{th})^2$, where $V_{gs}$ is the gate terminal to source terminal voltage, and $V_{th}$ is the threshold voltage of the first discharge transistor 532. As node A is coupled to the gate terminal of the first discharge transistor 532, $V_{gs}=V_A$. Furthermore, as mentioned above, $V_A=V_{th}+V_{data}$, thus, the expression for the current $I_{ds}$ flowing through the first discharge transistor 532 can be given by: $I_{ds}=k(V_{data}+V_{th}-V_{th})^2=k(V_{data})^2$. The current $I_{ds}$ is thus independent of the threshold voltage $V_{th}$ of the first discharge transistor 532. Accordingly, unpredictable variations in the threshold voltage $V_{th}$ do not affect the current flowing through the first discharge transistor 532. This improves the precision of controlling the current $I_{ds}$, which in turn improves the precision with which the display can control the duration of the shutter's OPEN and CLOSED states and the light output of each pixel for an image frame.

Figure 6:
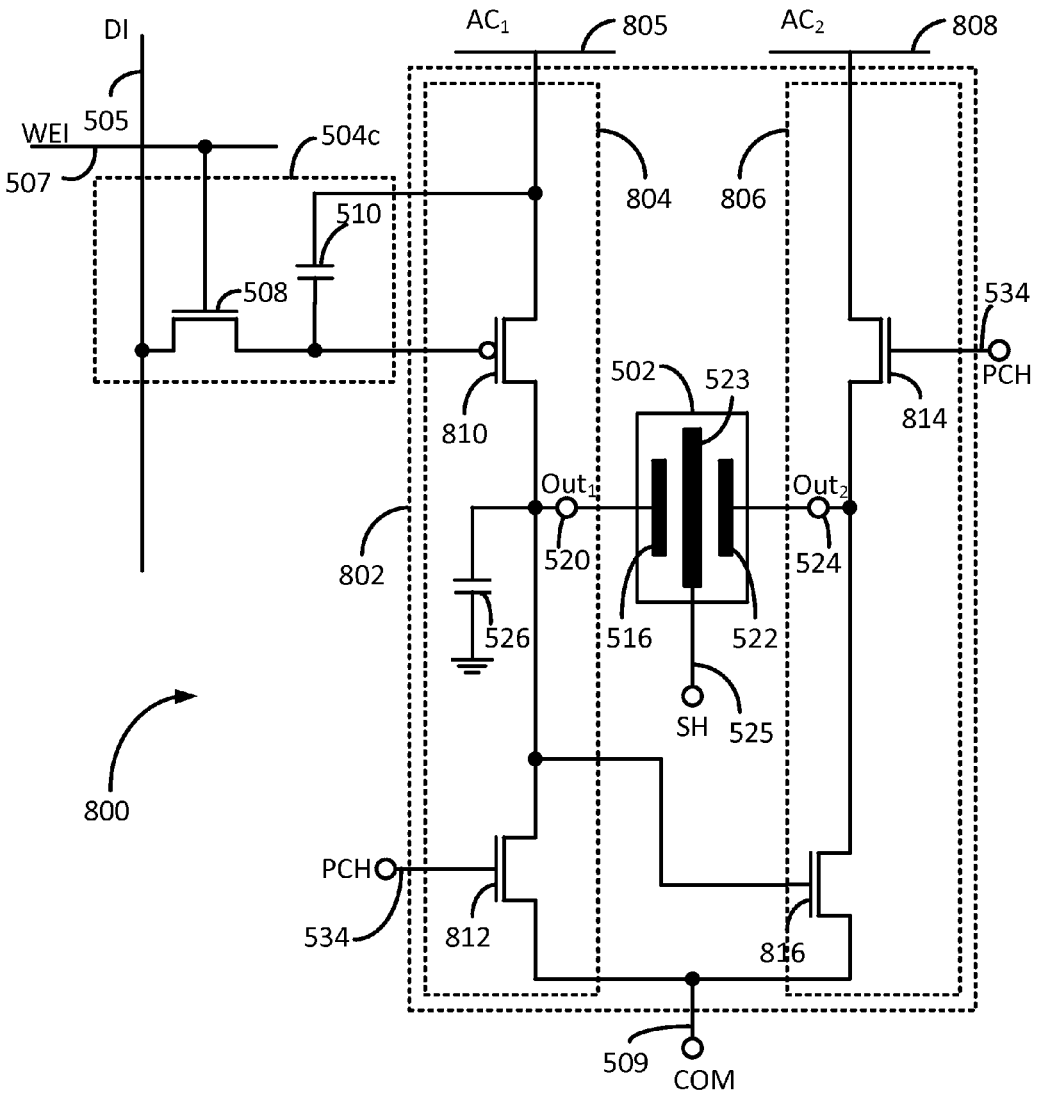
FIG. 6 shows a third example pixel circuit that can be implemented for controlling a light modulator.

FIG. 6 shows a third example pixel circuit 800 that can be implemented for controlling a light modulator 502. In particular, the pixel circuit 800 can be used to control dual actuator light modulators, such as the light modulator 400 shown in FIGS. 2A and 2B. The pixel circuit 800 can be part of a control matrix that controls an array of pixels that incorporate light modulators, such as the light modulator 502. The pixel circuit 800 shown in FIG. 6 is similar to the pixel circuits 500 and 700 shown in FIGS. 3 and 5, respectively, in that the pixel circuit 800 also uses an analog data voltage to control the duration of a state of the light modulator 502. However, unlike pixel circuits 500 and 700, which control the rate of discharge of an actuation voltage capacitor, the pixel circuit 800 instead controls the rate of charging an actuation voltage capacitor.

The pixel circuit 800, similar to the pixel circuits 500 and 700 shown in FIGS. 3 and 5, respectively, includes a data loading circuit 504*c* for loading the data voltage on the data storage capacitor 510. However, in the pixel circuit 800, one terminal of the data storage capacitor 510 is coupled to the actuation voltage interconnect 536 instead of to the common interconnect 509.

The data loading circuit 504*c* is coupled to the actuation circuit 802, which controls the light modulator 502. Specifically, the actuation circuit 802 includes a first output node ($Out_1$) 520 and a second output node ($Out_2$) 524 coupled to the first actuator 516 and the second actuator 522 of the light modulator 502. The actuation circuit 802 includes a first actuation sub-circuit 804 and a second actuation sub-circuit 806. The first actuation sub-circuit 804 is coupled to the data loading circuit 504*c*, a first actuation voltage interconnect ($AC_1$) 805, and a pre-charge interconnect 534. The second actuation sub-circuit 806 is coupled to the first actuation sub-circuit 804, a second actuation voltage ($AC_2$) interconnect 808, and the pre-charge interconnect 534. Both the first and the second actuation sub-circuits 804 and 806 are also coupled to a common interconnect 509.

The first actuation sub-circuit 804 includes a voltage controlled charging path and a discharging path for controlling the charge stored on the actuation voltage capacitor 526. The voltage controlled charging path includes a first charge transistor 810, which charges an actuation voltage capacitor 526 at a rate that is based on the magnitude of the data voltage stored in the data storage capacitor 510. In some implementations, such as the one shown in FIG. 6, the first charge transistor 810 can be a p-type MOSFET. The source terminal of the first charge transistor 810 is coupled to the first actuation voltage interconnect 805 and one end of the data storage capacitor 510. The gate terminal of the first charge transistor 810 is coupled to the other end of the data storage capacitor 510, while the drain terminal is coupled to the actuation voltage capacitor 526 and the first output node 520. The discharge path includes a first discharge transistor 812, which is used to discharge the actuation voltage capacitor 526. The discharge transistor is controlled by a pre-charge voltage on the pre-charge interconnect 534. The drain terminal and the source terminal of the first discharge transistor 812 are coupled to the actuation voltage capacitor 526 and the common interconnect 509.

The second actuation sub-circuit 806 also includes a charging path and a discharging path for charging and discharging the second output node 524. The second output node 524 is coupled to the second actuator 522, and the charging and discharging of the second output node 524 can be used to control the voltage provided to the second actuator 522. The charging path includes a second charge transistor 814, one terminal of which his coupled to the second actuation voltage interconnect 808 and the other terminal of which is coupled to the second output node 524. The gate terminal of the second charge transistor 814 is coupled to the pre-charge interconnect 534. The discharge path includes a second discharge transistor 816 coupled between the second output node 524 and the common interconnect 509. The gate terminal of the second discharge transistor 816 is coupled to the first output node 520 of the first actuation sub-circuit 804. Thus, when the voltage at the first output node 520 exceeds the threshold voltage of the second discharge transistor 816, the second discharge transistor 816 switches ON, allowing discharging of the second output node 524.

Figure 7:
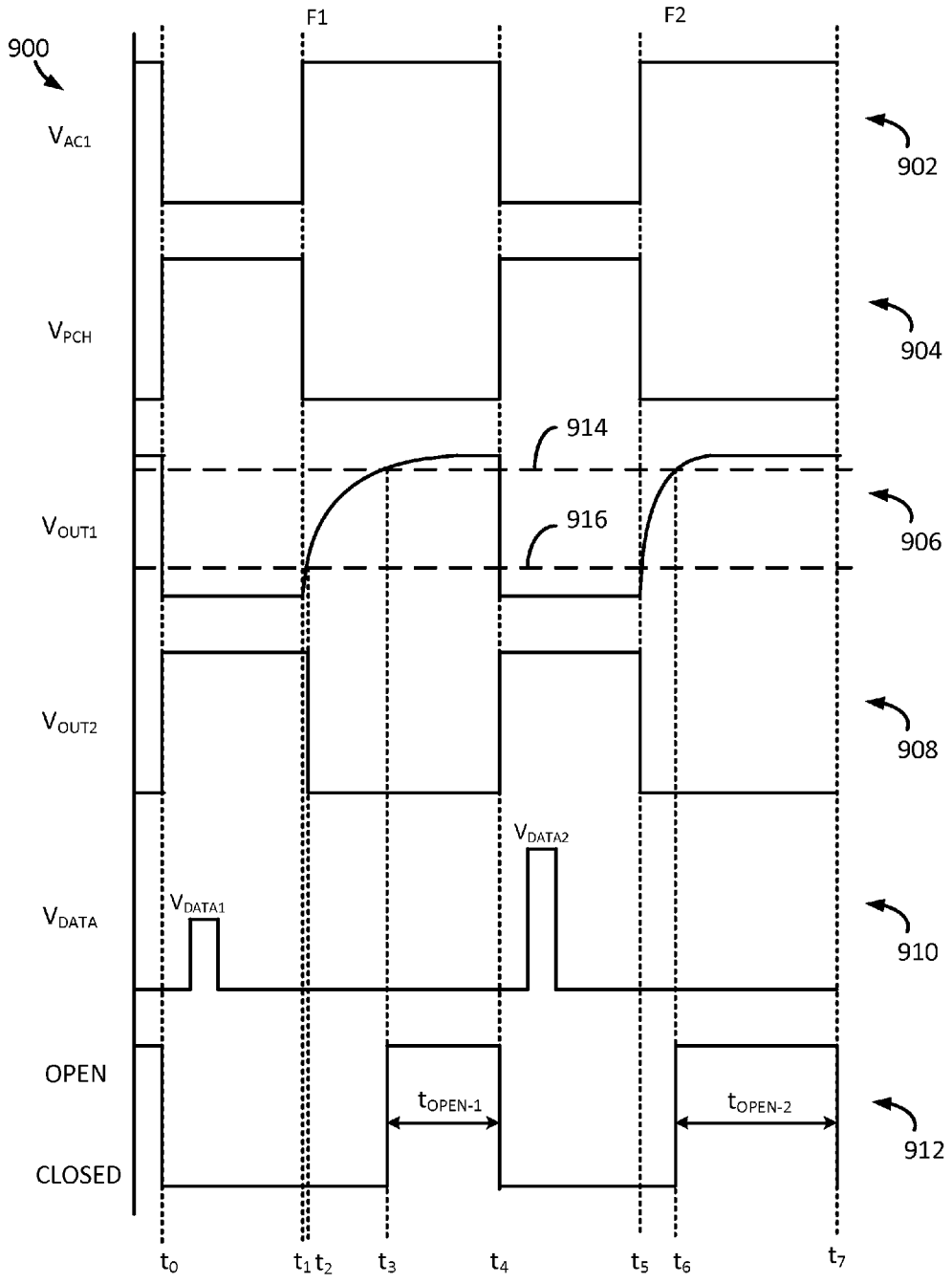
FIG. 7 shows an example timing diagram for the pixel circuit shown in FIG. 6.

FIG. 7 shows an example timing diagram 900 for the pixel circuit 800 shown in FIG. 6. In particular, the timing diagram 900 shows voltage levels at various nodes of the pixel circuit 800 over two image frames F1 and F2. $V_{AC1}$ 902 represents the voltage on the first actuation voltage interconnect 805, $V_{PCH}$ 904 represents the voltage on the pre-charge interconnect 534, $V_{OUT1}$ 906 represents the voltage at the first output node 520, $V_{OUT2}$ 908 represents the voltage at the second output node 524, $V_{DATA}$ 910 represents the data voltage on the data interconnect 505, and MODULATOR STATE 912 represents the state of the shutter 523 of the light modulator 502. The voltage (not shown) on the second actuation voltage interconnect 808 is typically maintained high. Each voltage shown in FIG. 7 generally swings between a high and a low value. But the high and low values for any one voltage may or may not be equal to the high and low values for another voltage. The rise and fall times for various voltages in the timing diagram 900 are merely for illustration, and may not represent the actual rise and fall times of these voltages.

Referring to both FIGS. 6 and 7, the first frame F1 begins at time $t_0$, at which time the voltage $V_{PCH}$ 904 on the pre-charge interconnect 534 is brought high and the first actuation voltage $V_{AC1}$ 902 on the first actuation voltage interconnect 805 is brought low. The second actuation voltage interconnect 808 is maintained high throughout the operation of the pixel circuit 800. As the pre-charge interconnect 534 is high, the first discharge transistor 812 and the second charge transistor 814 are switched ON. As a result, the voltage $V_{OUT1}$ 906 on the first output node 520 is brought low, and the voltage $V_{OUT2}$ on the second output node 524 is brought high. As the voltage on the second actuator 522 is high, the shutter 523 moves into a CLOSED state. A data voltage $V_{DATA1}$ 910 is applied to the data interconnect 505 and the write enable interconnect 507 is brought high. As a result, the data voltage $V_{DATA1}$ is loaded onto the data loading capacitor 510. After the data voltage $V_{DATA1}$ is loaded onto the data loading capacitor 510, the write enable interconnect 507 and the data interconnect 505 are brought low.

At time $t_1$, the first actuation voltage $V_{AC1}$ on the first actuation voltage interconnect 805 is brought high, and the voltage pre-charge voltage $V_{PCH}$ 904 on the pre-charge interconnect 534 is brought low. As a result, the first discharge transistor 812 and the second charge transistor 814 are switched OFF. The data voltage $V_{DATA1}$ is applied across the gate and source terminals of the first charge transistor 810, which acts as a voltage controlled current source. That is, the magnitude of current flowing through the first charge transistor 810 is a function of the data voltage $V_{DATA1}$. Furthermore, the rate of increase in the voltage $V_{OUT1}$ across the actuation voltage capacitor 526 depends, in part, upon the magnitude of the current flowing through the first charge transistor 810.

As the voltage $V_{OUT1}$ 906 increases, it rises above the threshold voltage 916 of the second discharge transistor 816 at time $t_2$. As a result, the second discharge transistor 816 switches ON and discharges the second output node 524 and brings the voltage $V_{OUT2}$ 908 to a low level. The voltage $V_{OUT1}$ continues to rise and reaches an actuation voltage 914 that is sufficient to actuate the first actuator 516 at time $t_3$. As a result, the shutter 523 moves to the OPEN state 912.

At the end of the frame F1 at time $t_4$, the pixel circuit 800 is brought to a state similar to its state at time $t_0$. Specifically, the voltage $V_{PCH}$ 904 on the pre-charge interconnect 534 is brought high and the first actuation voltage $V_{AC1}$ 902 on the first actuation voltage interconnect 805 is brought low. Thus, the shutter 523 returns to the CLOSED state 912. The duration of time during the frame F1 for which the shutter 523 remains in the OPEN state is indicated by duration $t_{OPEN-1}$.

During frame F2, a data voltage $V_{DATA2}$, which is greater than the data voltage $V_{DATA1}$ loaded during the first frame F1, is loaded by the data loading circuit 504*c*. At time $t_5$, the pixel circuit 800 is brought to a state that is similar to its state at time $t_1$, discussed above. That is, the first actuation voltage $V_{AC1}$ on the first actuation voltage interconnect 805 is brought high, and the voltage pre-charge voltage $V_{PCH}$ 904 on the pre-charge interconnect 534 is brought low. As the data voltage $V_{DATA2}$ loaded during frame F2 is greater than the data voltage $V_{DATA1}$ loaded during frame F1, the actuation voltage capacitor 526 is charged at a relatively faster rate during frame F2. Thus, the duration $t_{OPEN-2}$ from the time $t_5$, at which the voltage $V_{OUT1}$ begins to rise, to time $t_6$, at which the shutter 523 is moved into the OPEN state, is relatively greater than the duration $t_{OPEN-1}$ during frame F1. Finally, at time $t_7$ the duration of frame F2 ends and the pixel circuit 800 is brought to a state where data voltage for the subsequent frame can be loaded. Thus, as shown in FIG. 7, the duration for which the light modulator is maintained in a particular state can be controlled by controlling the magnitude of the data voltage.

Figure 8:
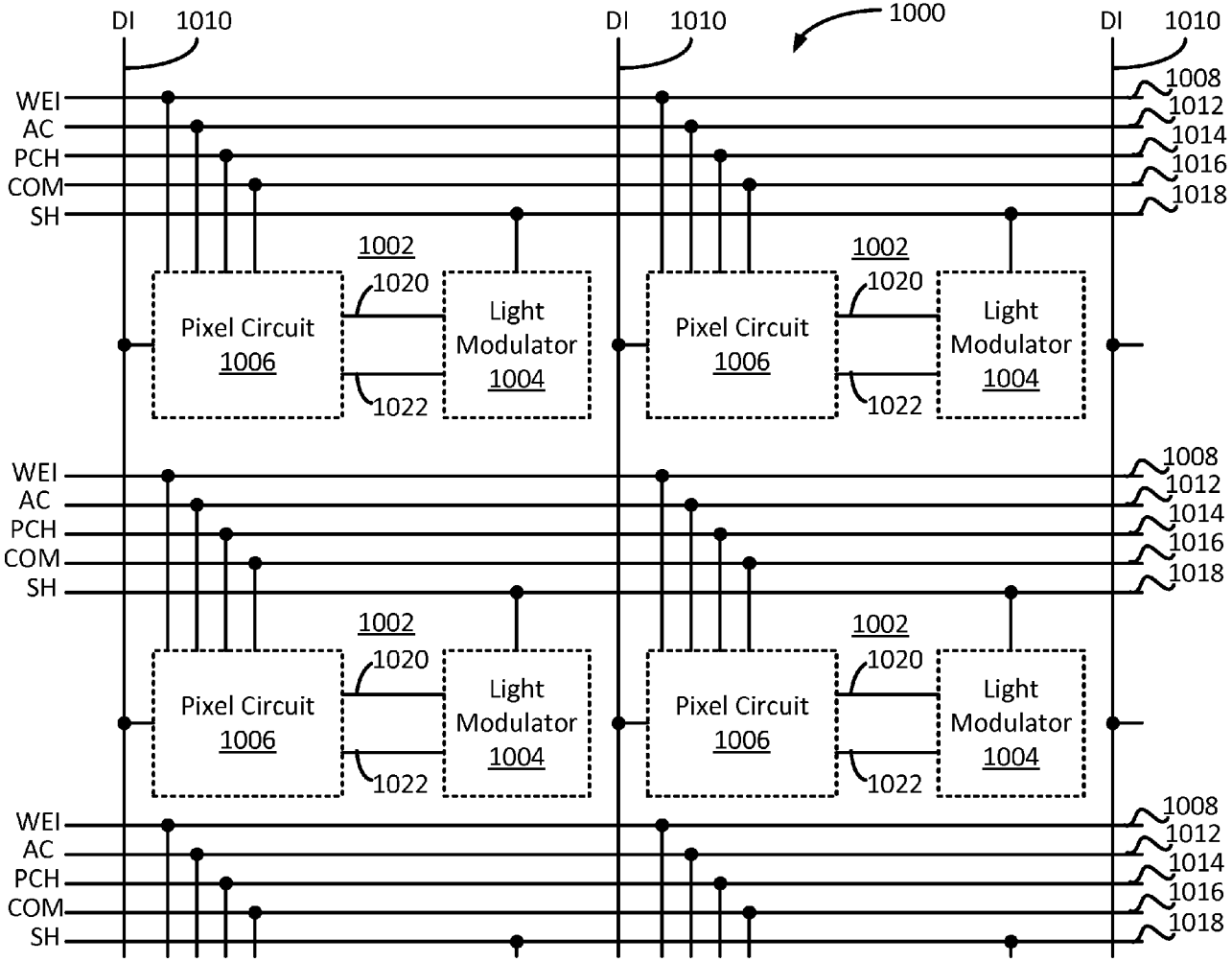
FIG. 8 shows a schematic diagram of an example control matrix.

FIG. 8 shows a schematic diagram of an example control matrix 1000. The control matrix 1000 is suitable for controlling the light modulators incorporated into the MEMS-based display apparatus 100 of FIG. 1A. The control matrix 1000 may address an array of pixels 1002. Each pixel 1002 can include a light modulator 1004, such as the dual actuator shutter assembly 400 of FIGS. 2A and 2B or the light modulator 502 shown in FIG. 3. Each pixel 1002 also can include a pixel circuit 1006, such as the pixel circuit 500 of FIG. 3. Furthermore, the control matrix 1000 also can be adapted to utilize the pixel circuit 700 or the pixel circuit 800 shown in FIGS. 5 and 6, respectively. For example, the control matrix 1000 can include an additional set-interconnect similar to the set-interconnect 546 of the pixel circuit 700; or include a second actuation voltage interconnect similar to the second actuation voltage interconnect 808 of the pixel circuit 800. While FIG. 8 shows the control matrix 1000 having only two rows and two columns of pixel 1002, it is understood that the control matrix 1000 can include additional rows and columns of pixels 1002.

The control matrix 1000 includes a write enable interconnect (WEI) 1008 for each row of pixels 1002 in the control matrix 1000 and a data interconnect (DI) 1010 for each column of pixels 1002 in the control matrix 1000. The write enable interconnect 507 and the data interconnect 505 shown in FIG. 3 are examples of such interconnects. Each write enable interconnect 1008 electrically connects a write-enabling voltage source to the pixels 1002 in a corresponding row of pixels 1002. Each data interconnect 1010 electrically connects a data voltage source to the pixels 1002 in a corresponding column of pixels 1002.

The control matrix 1000 also includes interconnects that are common to pixels 1002 in multiple rows and multiple columns of the control matrix 1000. In some implementations, the interconnects are common to pixels 1002 in all rows and columns of the control matrix 1000. The control matrix 1000 includes an actuation interconnect (AC) 1012, a pre-charge interconnect (PCH) 1014, a common or ground interconnect (COM) 1016 and a shutter interconnect (SH) 1018. In some implementations, the actuation voltage interconnect 536, the pre-charge interconnect 534, the common interconnect 509, and the shutter interconnect 525 shown in FIG. 3 are examples of the actuation interconnect 1012, the pre-charge interconnect 1014 the common or ground interconnect 1016 and the shutter interconnect 1018, respectively. As such, the actuation interconnect 1012 can provide an actuation voltage for the operation of the pixel circuit 1002, the pre-charge interconnect 1014 can provide a pre-charge voltage for the operation of the pixel circuit 1002, the common interconnect 1016 can provide a common or ground reference voltage for the operation of the pixel circuits 1006, and the shutter interconnect 1018 can provide a shutter voltage to each shutter in each light modulator 1004. The pixel circuit 1006 includes two output nodes 1020 and 1024 coupling the pixel circuit 1006 to the light modulator 1004, where each output node 1020 and 1024 carries a signal that controls one of the two actuators of the light modulator 1004. In some implementations, the first output node 520 and the second output node 524 shown in FIG. 3 can be examples of the two output nodes 1020 and 1024, respectively.

In operation, to form an image, the control matrix 1000 write-enables each row in the control matrix 1000 in a sequence by applying a write enabling voltage to each write enable interconnect 1008 in turn. While a row is write-enabled, analog data voltages representing pixel intensities of the pixels 1002 are selectively applied to the data interconnects 1010. For a write-enabled row, the application of the write enabling voltage enables the data loading circuit of each pixel circuit 1006 to store the data voltage provided on the data interconnect 1010. After providing data to all the pixels 1002 in all the rows, the control matrix 1000 controls the voltages on the first actuation interconnect 1012 and the pre-charge interconnect 1014 in a manner that is similar to that shown for first actuation interconnect 536 and the pre-charge interconnect 534 in relation to FIGS. 3 and 4 above.

Figure 9:
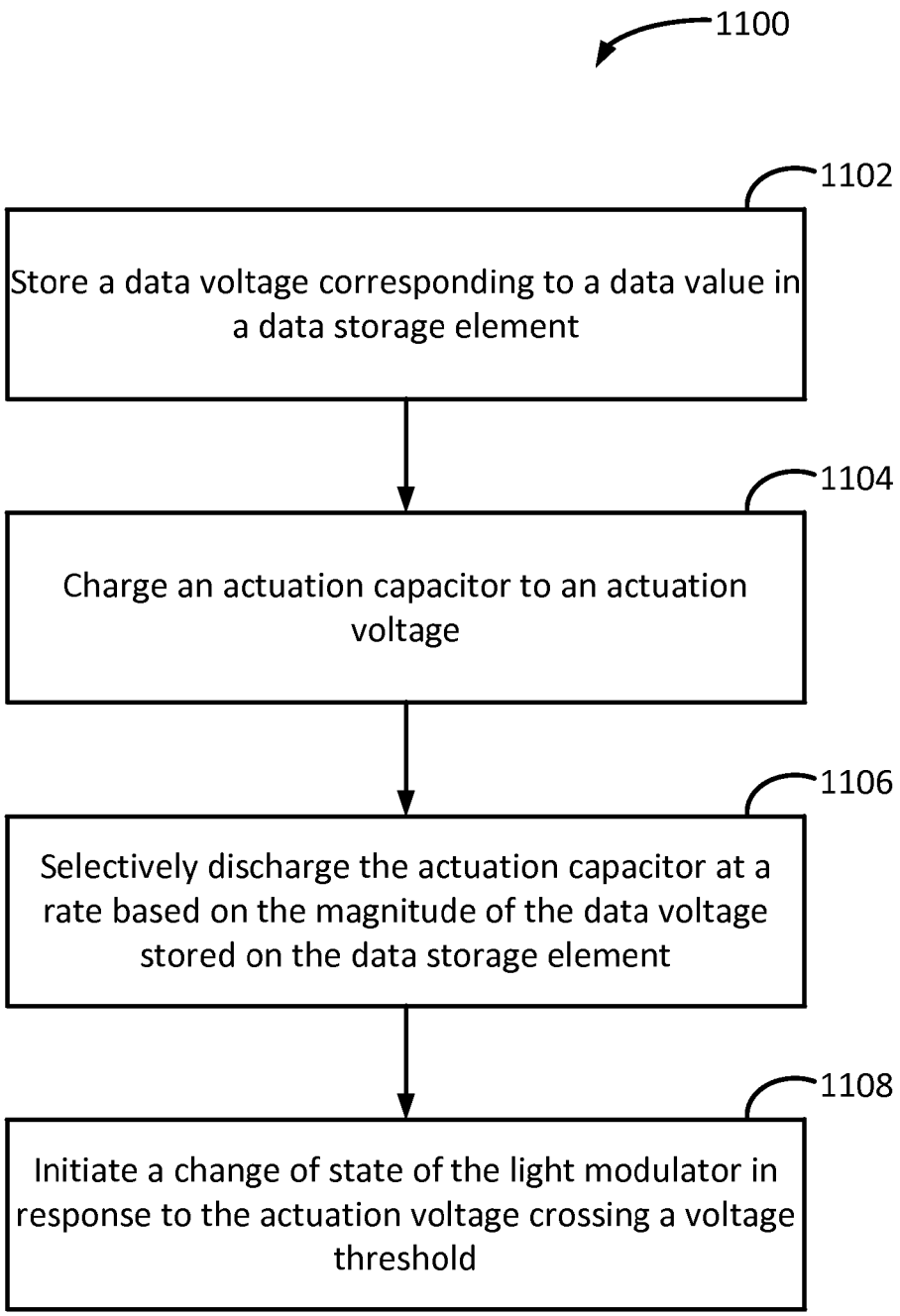
FIG. 9 shows an example flow diagram of a process for operating a dual actuator light modulator using a pixel circuit.

FIG. 9 shows an example flow diagram of a process 1100 for operating a dual actuator light modulator using a pixel circuit. In particular the process 1100 includes storing a data voltage corresponding to a data value in a data storage element (stage 1102), charging an actuation capacitor to an actuation voltage (stage 1104), selectively discharging the actuation capacitor at a rate based on the magnitude of the data voltage stored on the data storage element (stage 1106), and initiating a change of state of the light modulator in response the actuation voltage crossing a voltage threshold (stage 1108).

The process 1100 begins with storing a data voltage corresponding to a data value in a data storage element (stage 1102). One example of this process stage has been discussed above in relation to FIGS. 3 and 4. Specifically, FIG. 3 shows a data loading circuit 504*c* including a data storage capacitor 510 that is coupled to a data interconnect via a write enabling transistor 508. As shown in FIG. 4, a data voltage $V_{DATA}$ 608 is loaded on the data interconnect 505. This data voltage is stored on the data storage capacitor 510 by switching ON the write enabling transistor 508.

The process 1100 also includes charging an actuation capacitor to an actuation voltage (stage 1104). One example of this process stage has been discussed above in relation to FIGS. 3 and 4. Specifically, FIG. 3 shows an actuation voltage capacitor 526 that is coupled to an actuation voltage interconnect 536 via a pre-charge transistor 528. As shown in FIG. 4, when a pre-charge voltage $V_{PCH}$ 602 is brought high, the pre-charge transistor 528 is switched ON, and the voltage $V_{OUT1}$ 604 across the actuation voltage capacitor 526 increases due to the charging of the actuation voltage capacitor 526.

The process 1100 also includes selectively discharging the actuation capacitor at a rate based on the magnitude of the data voltage stored on the data storage element (stage 1106). One example of this process stage has been discussed above in relation to FIGS. 3 and 4. Specifically, FIG. 3 shows a first discharge transistor 532, which is configured to operate as voltage controlled current source. That is, the magnitude of the current flowing through the first discharge transistor 532 is based on the magnitude of the data voltage stored in the data storage capacitor 510. As shown in FIG. 4, at time $t_1$, the first discharge transistor 532 is switched ON, resulting in the discharging of the actuation voltage capacitor 526. The discharging of the actuation voltage capacitor 526, in turn, results in decay of the voltage $V_{OUT1}$ 604 across the actuation voltage capacitor 526. The rate at which the voltage $V_{OUT1}$ decays is based on the magnitude of the data voltage $V_{DATA}$.

The process 1100 further includes initiating a change of state of the light modulator in response the actuation voltage crossing a voltage threshold (stage 1108). One example of this process stage has been discussed above in relation to FIGS. 3 and 4. Specifically, FIG. 3 shows a second actuation sub-circuit 514 coupled to the actuation voltage capacitor 526. The second actuation sub-circuit 514 is configured to pull the voltage applied to a second actuator 522 high when the voltage across the actuation voltage capacitor 526 goes below a voltage threshold. As shown in FIG. 4, as the voltage $V_{OUT1}$ 604 decays below the voltage threshold $V_{threshold}$, the voltage $V_{OUT2}$ 606 applied to the second actuator 522 is pulled high. This results in the actuation of the second actuator 522 and the switching of the state of the light modulator 502 to a CLOSED state 610. The duration $t_{OPEN}$ for which the light modulator 502 remains in the OPEN position is based on the data voltage $V_{DATA}$. It should be noted that additional examples of each of the stages of the process 1100 have been discussed above in relation to the second example pixel circuit 700 shown in FIG. 5.

Figures 10A, 10B, 10C:
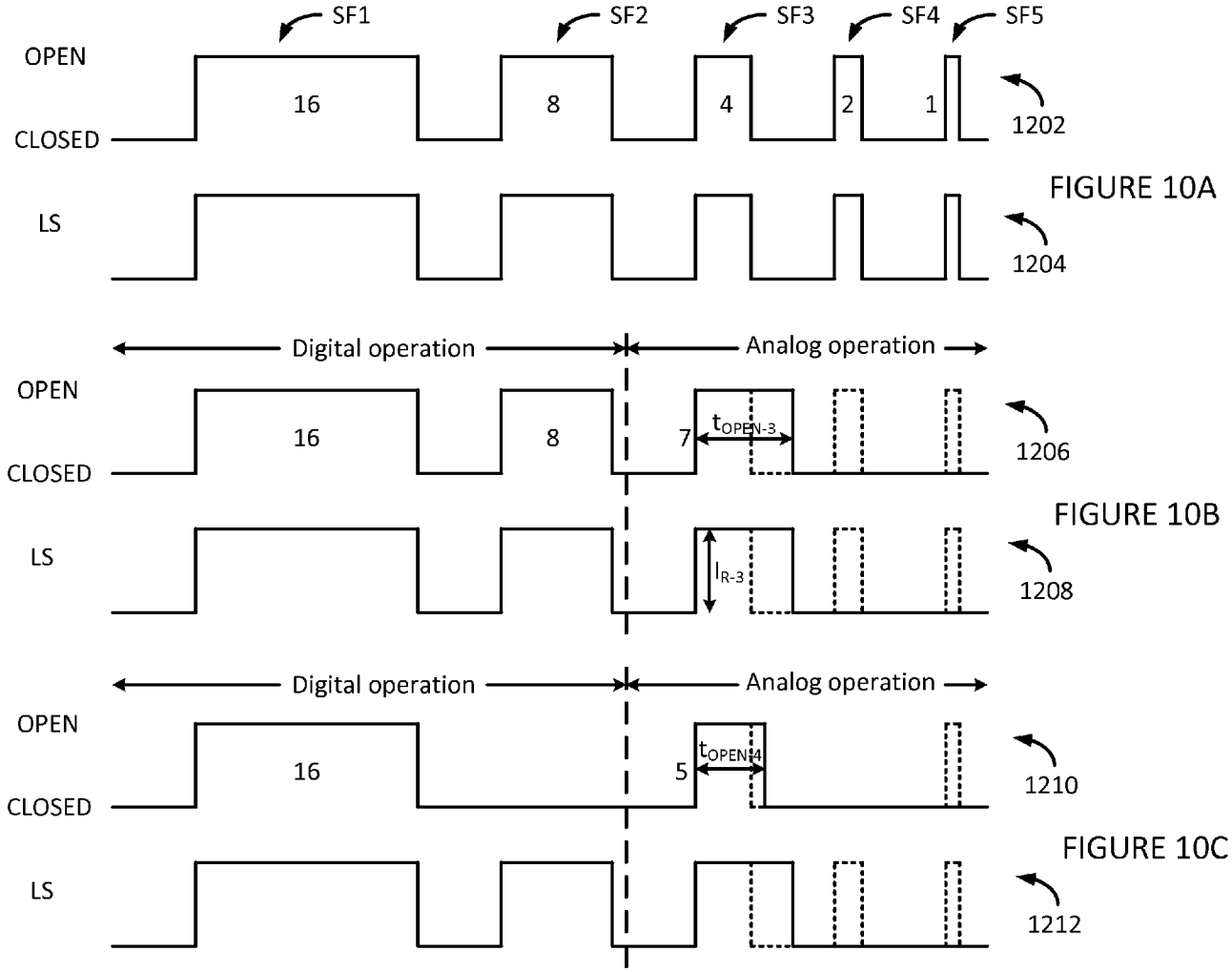
FIGS. 10A-10D show various timing diagrams illustrating an example hybrid digital-analog operation of a display apparatus.
Figure 10D:
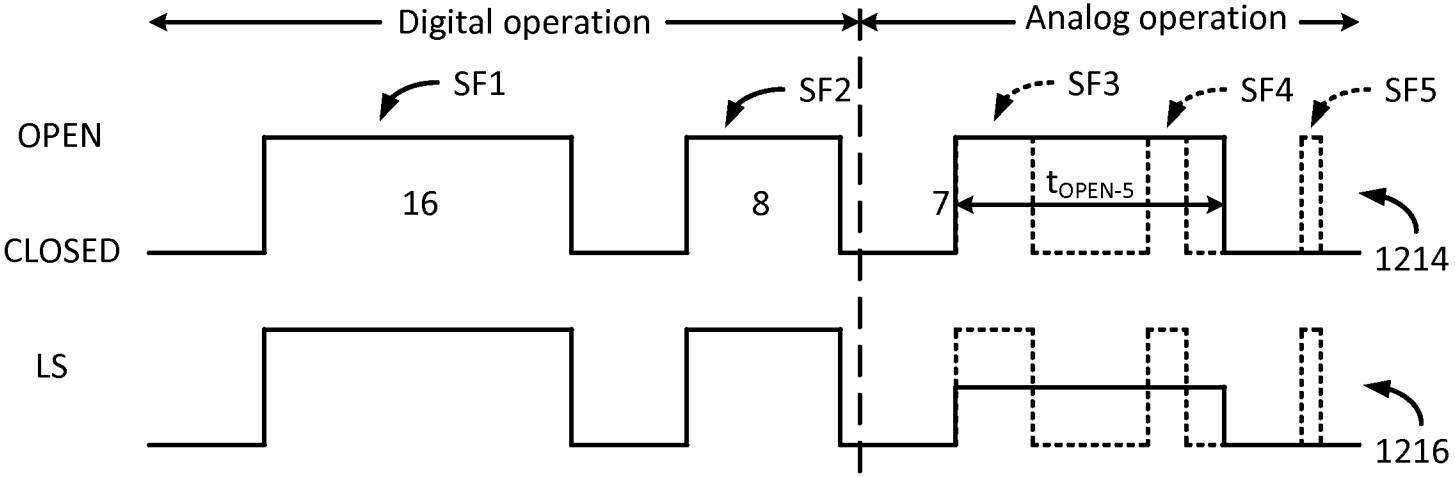

In some implementations, the pixel circuits discussed in relation to FIGS. 3, 5 and 6 can be utilized for both analog and digital modes of operation. FIGS. 10A-10D show various timing diagrams illustrating display apparatus operation. In particular, FIG. 10A shows the operation of the display apparatus for displaying images using only digital time division gray scale. In some implementations, a controller can cause the pixel circuits to operate in both analog and digital modes, providing a hybrid digital-analog mode of operation. FIGS. 10B-10D show examples of such a hybrid digital-analog mode of operation.

As indicated above, FIG. 10A shows the operation of a display apparatus employing digital time division gray scale. FIG. 10A shows the state 1202 of a pixel and the corresponding illumination state 1204 of a light source LS. The example shown in FIG. 10A illustrates a 5-bit, binary weighted, time division gray scale technique for displaying an image frame. Thus, FIG. 10A shows five subframes: a first subframe SF1, a second subframe SF2, a third subframe SF3, a fourth subframe SF4, and a fifth subframe SF5. The subframes are binary weighted with the first subframe SF1 having the highest weight (16) and each subsequent subframe having half the weight as that of the previous subframe. For generating a pixel intensity, the pixel intensity value can be converted into a 5-bit binary code, such that each bit from the most significant bit to the least significant bit corresponds to a subframe from the highest weighted subframe to the lowest weighted subframe. In addition, the value of each bit (0 or 1) indicates the CLOSED or OPEN state of the shutter during the subframe corresponding to the bit position. For example, in FIG. 10A, the pixel intensity value is 31, which can be represented in binary by 11111. Therefore, a shutter within the pixel is switched to the OPEN state for the entire duration of each of the five subframes. Similarly, a pixel intensity value of 25 would be represented in binary as 11001. As such, a shutter in a pixel generating an intensity value of 25 would be in the OPEN state for the first, second, and fifth subframes SF1, SF2, and SF5, having weights of 16, 8, and 1, respectively. The pixel would be closed during the third and fourth subframes SF3 and SF4, having weights of 4 and 2, respectively. A time period before each subframe is utilized for loading data (corresponding to OPEN or CLOSED) into the pixel circuit for each pixel. The loaded data determines the state of the shutter during the following subframe.

In the digital mode of operation, the shutter is either in the OPEN state or the CLOSED state for the entire duration of the subframe. For example, in FIG. 10A, the shutter is in the OPEN state for the entire duration of each of the five subframes. The desired state of the shutter can be achieved by loading an appropriate data voltage into the pixel circuit associated with the pixel. Such pixel circuits can include, for example, the pixel circuits 500, 700, and 800 shown in FIGS. 3, 5, and 6, respectively. While these pixel circuits have been described as operating in an analog mode, where the duration of a state of the shutter is based on the magnitude of the data voltage loaded onto the data interconnect 505, these pixel circuits also can be utilized to operate in a digital mode. To operate in the digital mode, a data voltage of one of two discrete values can be loaded onto the data interconnect, where each discrete value causes the pixel circuit to move the shutter to one of two states (OPEN and CLOSED) for the entire time a light source is illuminated during the subframe. For example, referring to FIG. 4, if the duration of the frame F1 were to be considered as the duration of a subframe, then a data voltage, preferably less than $V_{DATA1}$, can be loaded on the data interconnect such that the shutter remains in an OPEN state for the entire duration of the frame F1. Similarly, a data voltage, preferably greater than $V_{DATA2}$, can be loaded on the data interconnect such that the shutter remains CLOSED for the entire duration of the frame F2. In such a situation, the shutter may still move to the OPEN state during such a subframe, but the data voltage is sufficiently high that the voltage stored on an actuation voltage capacitor, such as the actuation voltage capacitor 526 depicted in FIG. 3, decays fast enough that the shutter reverts to the CLOSED state before the light source is turned on for the subframe. In this manner, the shutter, and the display apparatus as a whole, can be operated in the digital mode using the pixel circuits discussed above in FIGS. 3, 5 and 6.

FIGS. 10B and 10C show the states of the pixel and the corresponding states of a light source illuminating the pixel during a hybrid digital-analog operation for two different example pixel intensity values. In particular, FIG. 10B shows the states 1206 of the pixel and the corresponding states 1208 of the light source LS resulting from the pixel outputting an intensity value of 31 using a hybrid digital-analog mode of operation. FIG. 10C shows the states 1210 of the pixel and the corresponding states 1212 of the light source LS resulting from the pixel outputting an intensity value of 21 using the hybrid digital-analog mode of operation. In both examples, the pixel is operated in the digital mode to output the amount of light that would be output during the first and second subframes SF1 and SF2 were the pixel operated in a fully digital mode. The pixel is operated in the analog mode for the remaining duration of the image frame, thereby replacing the three lowest-weighted subframes with a single analog subframe.

As illustrated in FIG. 10B, light output corresponding to light that would have been output in the first two subframes SF1 and SF2 is generated in a digital mode. Thus, the states of the pixel and the light source LS during the first and second subframes SF1 and SF2 in FIG. 10B are similar to their states during subframes SF1 and SF2 of the fully digital operation shown in FIG. 10A. Specifically, the shutter is switched to the OPEN position and the light source LS is turned ON during the first and second subframes SF1 and SF2. After the second subframe SF2, the display apparatus switches to an analog mode of operation. In the analog mode, the shutter is not repeatedly switched between OPEN and CLOSED states to output the third, fourth, and fifth subframes SF3, SF4, and SF5. Instead, the shutter is switched to the OPEN state once, for a duration denoted by $t_{OPEN-3}$ and switched to the CLOSED state thereafter. For comparison, the states of the shutter and the light source LS using digital operation is shown in FIG. 10B using broken lines.

The duration $t_{OPEN-3}$ in the analog mode is determined by the desired pixel intensity value and the contribution to the total light output of the pixel generated by the pixel while operating in the digital mode. For example, the shutter is in the OPEN state in the first and second subframe SF1 and SF2. Thus, according to the binary weights associated with the first and second subframe SF1 and SF2 of 16 and 8, respectively, the digital mode of operation, which includes subframes SF1 and SF2, contributes a value of 24 to the desired pixel intensity of 31. Thus, to display the desired pixel intensity of 31 for the entire image frame, the analog mode would have to contribute light output corresponding to a pixel intensity value of 7. Accordingly, a data voltage $V_{DATA}$ that corresponds to a pixel intensity value of 7 can be loaded on the data interconnect coupled to the pixel. Generally, the duration $t_{OPEN-3}$ for which the shutter remains open in the analog mode will be substantially equal to the combined duration the shutter would have remained open in the third, fourth, and fifth subframes SF3, SF4 and SF5 if it were operating in the digital mode. Furthermore, the duration for which the light source is turned ON is at least equal to the duration $t_{OPEN-3}$ for which the shutter is in the OPEN state. As the light source LS is used to illuminate several, if not all, pixels in the display apparatus, the light source LS may be maintained in the ON state for at least as long as the longest shutter OPEN duration among all pixels.

As mentioned above, FIG. 10C shows a second example hybrid digital-analog mode of operation of the display apparatus. In this example, the desired pixel intensity has a value of 21. The 5-bit digital representation of the pixel intensity value 21 is given by: 10101. Accordingly, in a fully digital mode of operation (indicated by broken lines in FIG. 10C) employing a 5-bit, binary weighted, gray scale technique, the shutter would have to be switched to the OPEN position during the first, third, and fifth subframes SF1, SF3 and SF5. However, the display apparatus switches to an analog mode before the beginning of the third subframe SF3. Thus, the digital mode, in which the shutter is in the OPEN state only during the first subframe SF1, contributes a light output corresponding to a pixel intensity of 16 out of the total desired pixel intensity value of 21. Accordingly, the analog mode would have to additionally contribute a light output corresponding to a pixel intensity value of 5 to achieve the desired pixel intensity value of 21.

In the analog mode, the shutter is moved to the OPEN position for a duration $t_{OPEN-4}$, which is equivalent to the pixel intensity value of 5. Accordingly, a data voltage $V_{DATA}$ that corresponds to a pixel intensity value of 5 can be loaded on the data interconnect coupled to the pixel. Thus, the duration $t_{OPEN-4}$ will be substantially equal to the total duration of the subframes SF3 and SF5, during which the shutter would be OPEN were it operating in the digital mode.

For generating a specified pixel intensity, the analog mode of operation can take less time than the digital mode of operation. For example, referring to FIG. 10A, after the passage of the first subframe SF1 and the second subframe SF2, the digital mode of operation requires the completion of the third SF3, fourth SF4 and fifth SF5 subframes for generating a pixel intensity of 7. On the other hand, as shown in FIG. 10B, in the analog mode of operation, the generation of the same pixel intensity value of 7 is completed in relatively less time, i.e., at the end of the duration labeled $t_{OPEN-3}$. The time savings result from being able to use a single addressing stage for the portion of the image frame output using analog gray scale instead of having to use three separate addressing stages, one for each of the third, fourth, and fifth subframes SF3, SF4, and SF5, were the display operating in a fully digital mode. The additional time made available during an image frame by using analog mode of operation can be utilized in several ways. In some implementations, the duration of the image frame itself can be reduced to increase the frame rate. An increase in frame rate can reduce flicker and other image artifacts. In some other implementations, as discussed in relation to FIG. 10D, the additional time made available can be utilized to operate the light source LS at lower power.

FIG. 10D shows the states 1214 of the pixel and the corresponding states 1216 of the light source LS during a third example hybrid digital-analog mode of operation. In contrast to the analog portion of the hybrid mode of operation shown in FIG. 10B, the duration of the shutter OPEN state and the illumination intensity of the light source are adjusted such that the light source can be operated at a lower power without affecting the pixel intensity. In particular, the duration $t_{OPEN-5}$, i.e., the duration for which the shutter remains open and illuminated in FIG. 10D, is configured to be twice as long as the duration $t_{OPEN-3}$ shown in FIG. 10B. Accordingly, to generate the same pixel intensity value of 7 during the analog operation, the illumination intensity of the light source can be halved. Other scalings of shutter OPEN durations and illumination intensities also can be utilized.

A person having ordinary skill in the art will readily understand that in the hybrid digital-analog operation of the digital apparatus shown in FIGS. 10B-10D, the operation of a pixel can switch from digital to analog at any time during the image frame. For example, in some implementations, the operation may switch from digital to analog after the first subframe SF1, or after the third subframe SF3, instead of after the second subframe SF2, as shown in FIGS. 10B-10D. In some implementations, the image frame may begin with the display apparatus operating in the analog mode instead of the digital mode. In some implementations, the operation may switch between analog and digital more than once during the duration of the image frame.

Figure 11A:
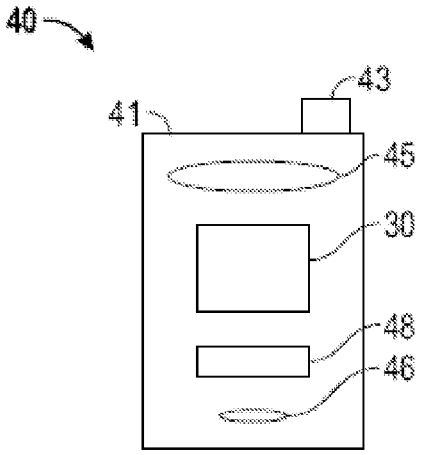
FIGS. 11A and 11B show system block diagrams of an example display device that includes a plurality of display elements.
Figure 11B:
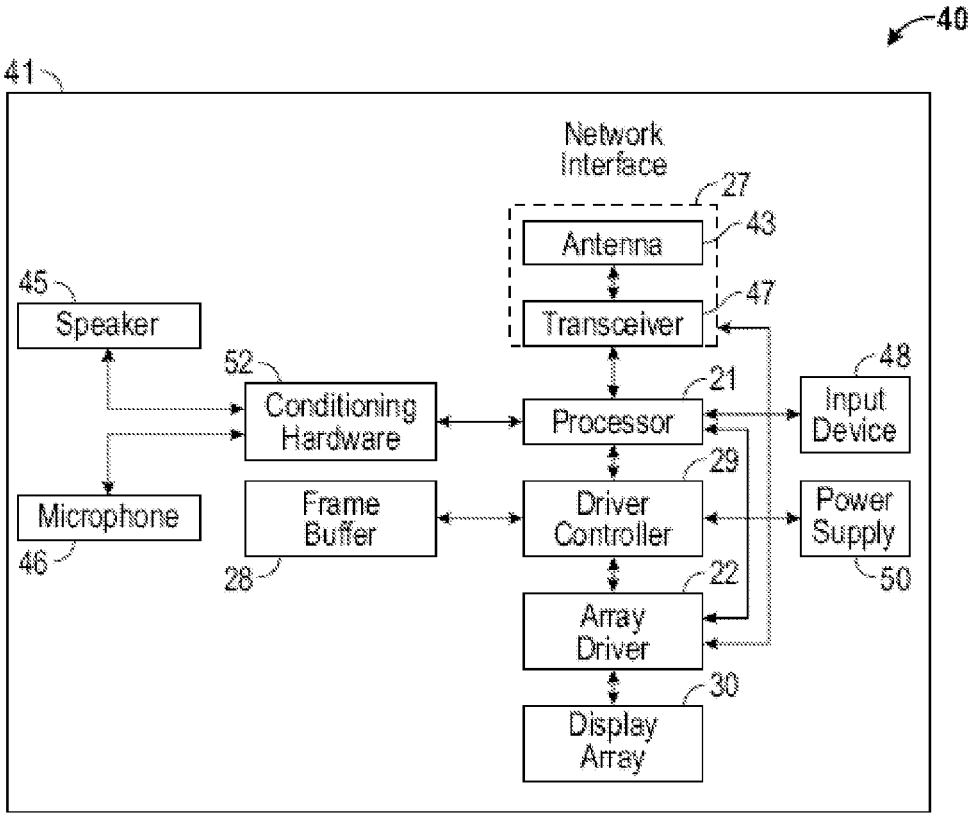

FIGS. 11A and 11B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 11B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 11A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1×EV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A display apparatus comprising:

a light modulator capable of switching between two discrete states; and a pixel circuit coupled to the light modulator, the pixel circuit including:

a data storage element capable of storing a data voltage corresponding to a data value;

an actuation charge capacitor;

an analog current source coupled to the data storage element and to the actuation charge capacitor, wherein the analog current source is capable of outputting a current having a magnitude which is based on the data voltage stored on the data storage element to alter an amount of charge and a voltage stored on the actuation charge capacitor at a variable rate;

a switch having a voltage threshold, coupled to the actuation charge capacitor, capable of initiating a change of state of the light modulator in response to the current output by the analog current source causing the voltage stored on the actuation charge capacitor to cross the voltage threshold of the switch, and a load protection switch positioned between the analog current source and the actuation charge capacitor capable of selectively preventing the analog current source from draining voltage stored on the actuation charge capacitor.

2. The display apparatus of claim 1, wherein the light modulator includes a first actuator and a second actuator, and the switch is capable of governing the actuation of one of the actuators.

3. The display apparatus of claim 2, wherein the actuation charge capacitor is coupled to the first actuator, and the voltage stored on the actuation charge capacitor governs the actuation of the other of the actuators.

4. The display apparatus of claim 3, wherein the analog current source is capable of draining the voltage stored on the actuation charge capacitor and one of the actuators.

5. The display apparatus of claim 1, wherein the analog current source is a transistor.

6. The display apparatus of claim 1, wherein the pixel circuit is capable of both analog and digital operation.

7. The display apparatus of claim 1, further comprising a threshold voltage compensation circuit coupled to the analog current source and the actuation charge capacitor, wherein the threshold voltage compensation circuit is capable of storing on the data storage element a compensation voltage substantially equal to a threshold voltage of the analog current source in addition to the data voltage.

8. The display apparatus of claim 1, wherein the switch is a voltage inverter.

9. The display apparatus of claim 1, further comprising:

a display including:

the array of display elements, and the control matrix, a processor that is capable of communicating with the display, the processor being capable of processing image data; and a memory device that is capable of communicating with the processor.

10. The display apparatus of claim 9, the display further including:

a driver circuit capable of sending at least one signal to the display; and a controller capable of sending at least a portion of the image data to the driver circuit.

11. The display apparatus of claim 9, further including:

an image source module capable of sending the image data to the processor, wherein the image source module comprises at least one of a receiver, transceiver, and transmitter.

12. The display apparatus of claim 9, the display device further including:

an input device capable of receiving input data and to communicate the input data to the processor.

13. A method for actuating a light modulator capable of switching between two discrete states using a pixel circuit coupled to the light modulator, comprising:

storing a data voltage corresponding to a pixel intensity in a data storage element;

charging an actuation capacitor to an actuation voltage;

selectively discharging the actuation capacitor via a voltage controlled current source at a rate based on the magnitude of the data voltage stored on the data storage element and applied to the voltage controlled current source, wherein selectively discharging the actuation capacitor includes selectively controlling a state of a load protection switch connected between the actuation capacitor and the voltage controlled current source to selectively prevent the voltage controlled current source from draining a voltage stored in the actuation capacitor; and initiating a change of state of the light modulator in response the actuation voltage crossing a voltage threshold.

14. The method of claim 13, further comprising applying an additional compensation voltage to the voltage controlled current source, wherein the compensation voltage is equal to a threshold voltage of the voltage controlled current source.

15. The method of claim 13, further comprising switching the light modulator to an open state when the actuation capacitor is charged to the actuation voltage.

16. A non-transitory computer readable storage medium having instructions encoded thereon, which when executed by a processor cause the processor to perform a method for displaying an image, comprising:

causing storage of a data voltage corresponding to a pixel intensity in a data storage element;

initiating charging an actuation capacitor to an actuation voltage;

causing selective discharge of the actuation capacitor via a voltage controlled current source at a rate based on the magnitude of the data voltage stored on the data storage element and applied to the voltage controlled current source, wherein causing selective discharge of the actuation capacitor includes selectively controlling a state of a load protection switch connected between the actuation capacitor and the voltage controlled current source to selectively prevent the voltage controlled current source from draining a voltage stored in the actuation capacitor; and initiating a change of state of the light modulator in response the actuation voltage crossing a voltage threshold.

* * * * *